US008067336B2

(12) United States Patent
Yokozawa et al.

(10) Patent No.: US 8,067,336 B2
(45) Date of Patent: Nov. 29, 2011

(54) CARDBOARD CYLINDER FOR A HEAT-SENSITIVE TRANSFER IMAGE-RECEIVING SHEET, ROLLED HEAT-SENSITIVE TRANSFER IMAGE-RECEIVING SHEET TO FORM A ROLL SHAPE, AND IMAGE-FORMING METHOD

(75) Inventors: Akito Yokozawa, Minami-ashigara (JP); Hiroshi Hatakeyama, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 842 days.

(21) Appl. No.: 12/107,909

(22) Filed: Apr. 23, 2008

(65) Prior Publication Data

US 2008/0269048 A1 Oct. 30, 2008

(30) Foreign Application Priority Data

Apr. 25, 2007 (JP) ..... 2007-115677

(51) Int. Cl.
*B41M 5/26* (2006.01)

(52) U.S. Cl. ... 503/227; 428/34.2; 428/35.7; 428/36.91; 428/512; 428/513; 428/913; 428/914

(58) Field of Classification Search ..... 428/32.39, 428/32.5, 34.2, 513, 35.7, 36.9, 6.91, 512, 428/913; 503/227; 242/610.4, 610.6
See application file for complete search history.

(56) References Cited

U.S. PATENT DOCUMENTS

| | | | | |
|---|---|---|---|---|
| 2,944,298 | A * | 7/1960 | Bernhardt et al. | 156/244.14 |
| 2,997,170 | A * | 8/1961 | Lowry et al. | 206/503 |
| 3,587,656 | A * | 6/1971 | Cunningham | 38/144 |
| 5,393,582 | A * | 2/1995 | Wang et al. | 428/34.2 |
| 5,426,087 | A * | 6/1995 | Pope et al. | 503/227 |
| 5,569,638 | A * | 10/1996 | Shirai et al. | 503/227 |
| 5,592,208 | A * | 1/1997 | Shinozaki et al. | 347/171 |

FOREIGN PATENT DOCUMENTS

| | | |
|---|---|---|
| EP | 1 375 172 A1 | 1/2004 |
| JP | 62-110997 | 5/1987 |
| JP | 5-116851 | 5/1993 |

OTHER PUBLICATIONS

"Plastic properties of low density polyethylene" acquired from http://www.dynalabcorp.com/technical_info_ld_polyethylene.asp on Feb. 26, 2011.*

* cited by examiner

*Primary Examiner* — Gerard Higgins
(74) *Attorney, Agent, or Firm* — Sughrue Mion, PLLC

(57) ABSTRACT

A cardboard cylinder for winding a heat-sensitive transfer image-receiving sheet having a receptive layer on one surface of a support around the cardboard cylinder, wherein an innermost surface of the cardboard cylinder is composed of a layer containing a polyolefin resin having a number average molecular weight of 12,000 or more in a proportion of at least 80% by mass based on the layer.

7 Claims, 2 Drawing Sheets

Fig. 2 (a)
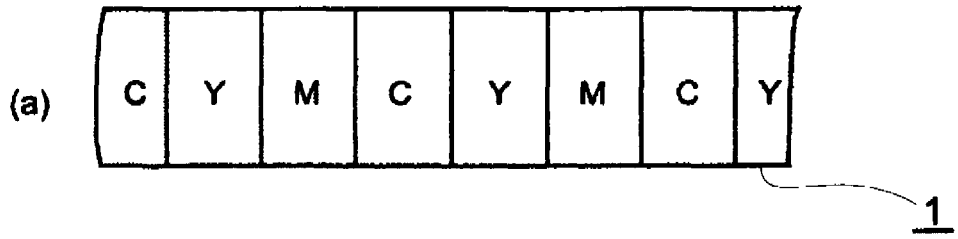
Fig. 2 (b)
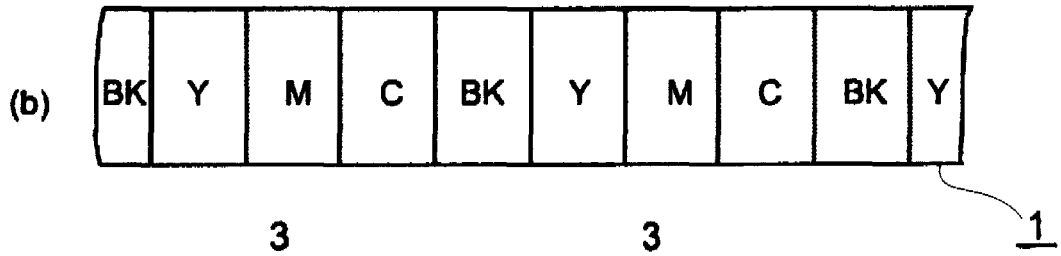
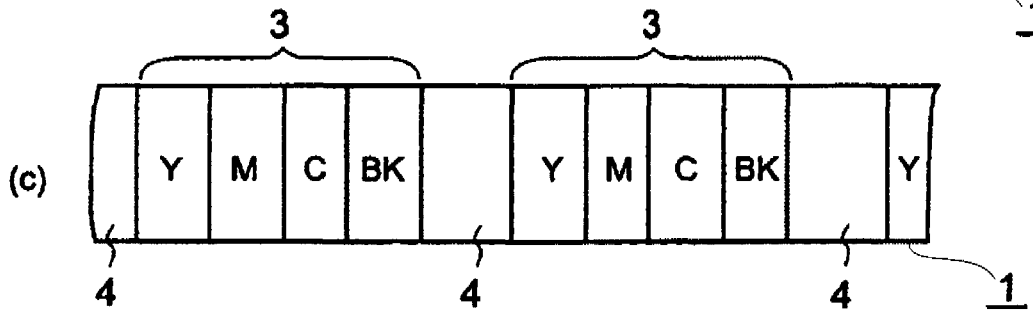
Fig. 2 (c)
Fig. 3
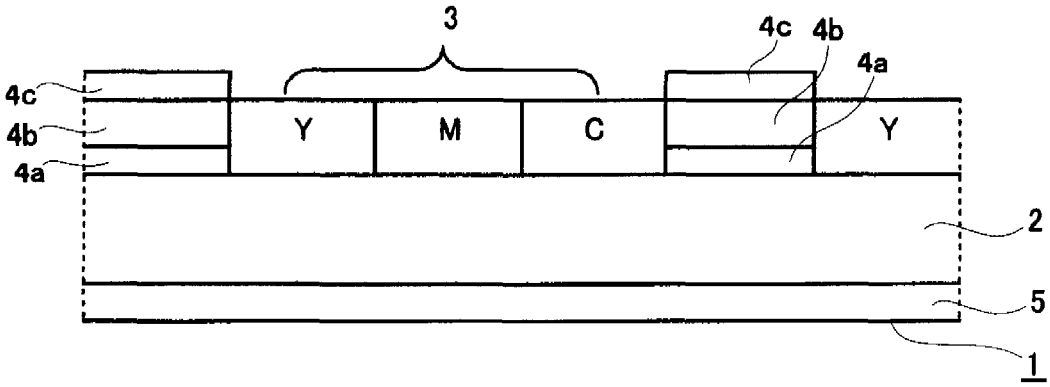

CARDBOARD CYLINDER FOR A HEAT-SENSITIVE TRANSFER IMAGE-RECEIVING SHEET, ROLLED HEAT-SENSITIVE TRANSFER IMAGE-RECEIVING SHEET TO FORM A ROLL SHAPE, AND IMAGE-FORMING METHOD

FIELD OF THE INVENTION

The present invention relates to a cardboard cylinder for a heat-sensitive transfer image-receiving sheet, a rolled heat-sensitive transfer image-receiving sheet to form a roll shape, and an image-forming method. More specifically, the present invention relates to a cardboard cylinder for a heat-sensitive transfer image-receiving sheet suitable for high speed print, a rolled heat-sensitive transfer image-receiving sheet wound on the cardboard cylinder, and an image-forming method utilizing a heat-sensitive transfer system.

BACKGROUND OF THE INVENTION

Various heat transfer recording methods have been known so far. Among these methods, a dye diffusion transfer recording systems attract attention as a process that can produce a color hard copy having an image quality closest to that of silver halide photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver halide photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta and yellow, are used for recording a color image by overlapping one color to other, thereby enabling transferring and recording a color image having continuous gradation for color densities.

Recently, various printers allowing higher-speed printing have been developed and commercialized increasingly in the field of the dye-diffusion transfer recording systems. The high speed print enables to shorten a waiting time when a user obtains a print in a shop. For the foregoing reason, there is a demand for further speeding up of printing.

For the high speed print, it is necessary to convey a heat-sensitive transfer sheet and a heat-sensitive transfer image-receiving sheet at higher speed in a printer. Accordingly, the high speed conveyance results in load of greater torque at the time of both start and stop.

In the heat-sensitive transfer image-receiving sheet, a thick support is used so as to give a sufficient strength to a finished print. Therefore, the image-receiving sheet is heavier than the heat-sensitive transfer sheet, which results in load of greater torque to the image-receiving sheet even though their conveying speed histories are the same. For the reason that a surface of the receptive layer side of the image-receiving sheet is the same as the side on which an image is formed, there arises image defect (failure) owing to friction inside the printer when the heat-sensitive transfer image-receiving sheet is conveyed in the printer. Therefore, the printer is designed in order that such the image defect does not occur. However, the surface opposite to the receptive layer side sometimes gets caught inside the printer in contact therewith. Further, inside the printer a torque is also loaded between the innermost surface of the heat-sensitive transfer image-receiving sheet wound in a roll shape and a shaft unit inserted in the rolled image-receiving sheet. In this area, sometimes slip occurs when a torque is loaded. For the reason that it is difficult to convey the heat-sensitive transfer image-receiving sheet according to the fixed manner because the foregoing "get caught" and slip occur, there arise strain and extraordinary tension in the heat-sensitive transfer sheet. Resultantly, sometimes normal prints cannot be obtained. Therefore, it has been desired to improve such the trouble. The higher the moving speed of the heat-sensitive transfer image-receiving sheets becomes and/or the greater the mass of the heat-sensitive transfer image-receiving sheet wound in a roll shape becomes, the greater the load of torque to the heat-sensitive transfer image-receiving sheet itself and between the innermost surface of the heat-sensitive transfer image-receiving sheet wound in a roll shape and a shaft unit inserted in the rolled image-receiving sheet. Consequently, they become more easily to slip. Therefore, control of slipping properties is a current important problem to be solved.

In order to control the foregoing slipping properties, it is considered to hold a heat-sensitive transfer image-receiving sheet in the state that the image-receiving sheet is wound around a cardboard cylinder, and to individually set suitable physical properties so that an inner surface of the cardboard cylinder is made difficult to slip, thereby to make it difficult to slip between the rolled heat-sensitive transfer image-receiving sheet and a shaft unit, whereas a surface of heat-sensitive transfer image-receiving sheet is made easy to slip, thereby to make it difficult to get caught. With respect to making a cardboard surface difficult to slip, for example, JP-A-62-110997 ("JP-A" means unexamined published Japanese patent application) and JP-A-5-116851 disclose a method of forming an anti-slipping layer, which method includes: coating the cardboard surface with a water dispersion containing a particular latex styrene/butadiene copolymer, polystyrene fine-particles, and a particular polyether compound; and a method of forming an anti-slipping layer, which method includes: coating the cardboard surface with expandable microcapsules in the state of pre-expansion, thereafter producing a cardboard cylinder by employing the thus-coated cardboard, and then foaming the microcapsules by means of heating.

As a result of studies on the inner surface of the cardboard cylinder obtained by any of those techniques, it was found that coefficient of friction was indeed enhanced, but these techniques still caused such problems that anti-slipping effect was insufficient to the instant heat-sensitive transfer print.

SUMMARY OF THE INVENTION

The present invention resides in a cardboard cylinder, which is adapted for winding a heat-sensitive transfer image-receiving sheet having a receptive layer on one surface of a support around the cardboard cylinder, wherein an innermost surface of said cardboard cylinder is composed of a layer containing a polyolefin resin having a number average molecular weight of 12,000 or more in a proportion of at least 80% by mass based on the layer.

Further, the present invention resides in a rolled heat-sensitive transfer image-receiving sheet to form a roll shape, wherein said heat-sensitive transfer image-receiving sheet has a receptive layer on one surface of a support and is wound around the above-described cardboard cylinder, and wherein an outermost surface of the heat-sensitive transfer image-receiving sheet opposite to the surface having the receptive layer thereon is composed of a polymer layer containing inorganic fine-particles.

Further, the present invention resides in an image-forming method, which comprises: using the above-described rolled heat-sensitive transfer image-receiving sheet to form a roll shape, to produce a heat-sensitive transfer print, wherein said heat-sensitive transfer print is produced at a linear speed of 20 cm/min or more.

Other and further features and advantages of the invention will appear more fully from the following description, appropriately referring to the accompanying drawings.

BRIEF DESCRIPTION OF THE DRAWINGS

FIGS. 2(*a*), 2(*b*), and 2(*c*) each are a plan view showing a preferable embodiment of the heat-sensitive transfer sheet for use in the present invention.

FIG. 3 is a cross-sectional view showing another preferable embodiment of the heat-sensitive transfer sheet for use in the present invention.

DETAILED DESCRIPTION OF THE INVENTION

Figure 1:
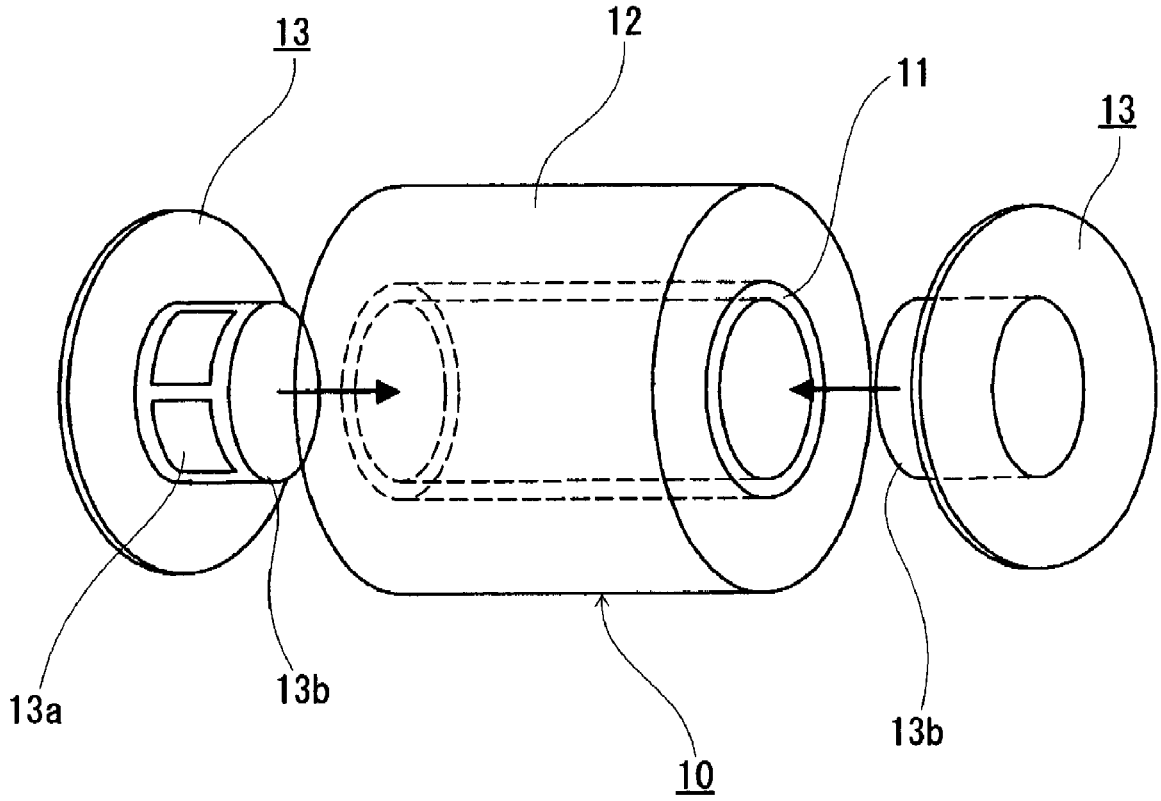
FIG. 1 is a perspective view showing an example of relation of a cardboard cylinder (11) of the present invention, a heat-sensitive transfer image-receiving sheet (12) wound around the cardboard cylinder, and a shaft unit (13).

The present invention provides the following means:

(1) A cardboard cylinder for winding a heat-sensitive transfer image-receiving sheet having a receptive layer on one surface of a support around the cardboard cylinder, wherein an innermost surface of said cardboard cylinder is composed of a layer containing a polyolefin resin having a number average molecular weight of 12,000 or more in a proportion of at least 80% by mass based on the layer.

(2) The cardboard cylinder according to item (1), wherein the polyolefin resin is a polyethylene resin.

(3) The cardboard cylinder according to item (1) or (2), wherein a melting point of the polyolefin resin is within the range from 105° C. to 180° C.

(4) A rolled heat-sensitive transfer image-receiving sheet to form a roll shape, wherein said heat-sensitive transfer image-receiving sheet has a receptive layer on one surface of a support and is wound around the cardboard cylinder according to any one of items (1) to (3), and wherein an outermost surface of the heat-sensitive transfer image-receiving sheet opposite to the surface having the receptive layer thereon is composed of a polymer layer containing inorganic fine-particles.

(5) The rolled heat-sensitive transfer image-receiving sheet to form a roll shape according to item (4), whose mass is within the range from 1.0 kg to 10 kg (preferably from 1.5 kg to 8 kg).

(6) An image-forming method, comprising: using the rolled heat-sensitive transfer image-receiving sheet to form a roll shape according to item (4) or (5), to produce a heat-sensitive transfer print, wherein said heat-sensitive transfer print is produced at a linear speed of 20 cm/min or more (preferably 50 cm/min or more).

The present invention is explained in detail below.

-Cardboard Cylinder-

In the present invention, the innermost surface of the cardboard cylinder is composed of a layer containing polyolefin resin having a number average molecular weight of 12,000 or more in a proportion of at least 80% by mass based on the layer. The number average molecular weight of the foregoing polyolefin resin is preferably 13,000 or more, and most preferably from 14,000 to 50,000. Further, a content of the polyolefin resin is preferably 90% by mass or more, and most preferably 95% by mass or more. It is possible to additionally contain additives such as plasticizers within the foregoing range.

The molecular weight can be obtained by a publicly known method such as a method of measuring a molecular weight distribution according to GPC (Gel Permeation Chromatography) to calculate a molecular weight, or an osmometry. The method using the GPC is convenient.

A melting point of the foregoing polyolefin resin is preferably within the range from 105° C. to 180° C., more preferably from 110° C. to 160° C. With respect to the melting point of the resin, there exists a case where a definite value is not indicated in measurement. In that case, a softening point is adopted in place of the foregoing melting point.

An amount of the foregoing innermost surface layer is preferably within the range from 1 g/m$^2$ to 100 g/m$^2$, most preferably from 5 g/m$^2$ to 80 g/m$^2$. Further, a thickness of the foregoing innermost surface layer is preferably within the range from 1 μm to 100 μm, most preferably 5 μm to 80 μm.

Examples of the foregoing polyolefin that can be used include polyethylene, polypropylene, and polybutylene. Of these resins, polyethylene is preferred. A low density polyethylene is more preferably used. Another preferable embodiment is to blend the low density polyethylene with a high density polyethylene and/or polypropylene for use.

It is preferred that the foregoing polyolefin resin has a melt index of from 1.0 to 40 g/10-min and has extrudability.

As the polyethylene, there are known those materials that have been used as a wax. Formation of a wax layer at the innermost surface is against the nature of the present invention because such the formation of a wax layer improves slipping properties. Therefore, polyethylene that is used for wax is not included within a category of the polyolefin defined with respect to the innermost surface of the cardboard cylinder. As described in "*Kirk Othmer Kagaku Daijiten*", compiled under supervision of Jiro Shiokawa, published by Maruzen (1988), p. 1453, the wax is a solid that becomes soft at room temperature and has a melting point of about 40° C. to about 90° C. A polyethylene wax has a molecular weight of 10,000 or less, and therefore the wax is also apparently different in definition of molecular weight from the olefin resin having average molecular weight of 12,000 or more at the innermost surface of the cardboard cylinder that is defined by the present invention.

Further, JU-A-7-23765 ("JU-A" means unexamined published Japanese utility model application) discloses that an outer surface of the cardboard cylinder is subjected to a polyethylene laminate treatment, an inner surface thereof is subjected to a wax treatment, and an end surface thereof is coated with an adhesive paste, for the purpose of prevention from dust. However, as described above, it is apparent that the wax treatment at the inner surface is outside of the scope of the present invention, and effects of the present invention cannot be attained by the polyethylene laminate treatment at the outer surface of the cardboard cylinder. Therefore, the structure or constitution disclosed in the foregoing Japanese utility model publication is different from that of the present invention.

The cardboard cylinder of the present invention can be produced, for example, by spirally rolling several plane cardboards at several times into a laminate, making the laminate into a cylindrical form by adhering each of layers with an adhesive to fix them, and then cutting the cylindrical laminate to a desired length. However, a method for the production of the cardboard cylinder is not limited to the foregoing method. For the production of the cardboard cylinder, use can be made of various materials such as a base paper of the cardboard, a liner board, and a straw board. A resin layer at the innermost surface can be formed by a method of producing a cardboard cylinder in which a previously resin-laminated paper is used at the innermost surface of the cardboard cylinder, or alternatively by a method of coating a molten resin or a resin-containing liquid, or by adhering a previously resin-laminated paper with an adhesive, on the innermost surface of the cardboard cylinder, after production of the cardboard cylinder. However, it is preferred that a cardboard cylinder is produced using a previously resin-laminated paper at the innermost surface of the cardboard cylinder. An example of a preferable embodiment for production of the cardboard cylinder includes a method of producing a cardboard cylinder by spirally rolling one round a polyethylene-laminated wood free paper so that the laminated face can be disposed inside, subsequently rolling thereon linerboards plural rounds to superpose these layers and adhering each of the layers with an adhesive to fix them, and thereafter cutting the end surface of the product to an even length.

From viewpoints of both strength and lightness of a cardboard cylinder, a thickness of the cardboard cylinder is preferably within the range from 0.1 mm to 10 mm, most preferably from 0.4 mm to 5 mm.

A diameter of the cardboard cylinder is preferably within the range from 5 mm to 50 mm, most preferably from 10 mm to 40 mm.

-Outermost Surface of Heat-sensitive Transfer Image-receiving Sheet Opposite to Receptive Layer Side- In the present invention, it is preferable to give slipping properties to the outermost surface of the heat-sensitive transfer image-receiving sheet at the side of no receptive layer being formed (the side opposite to the receptive layer) in order to prevent the outermost surface from getting caught inside a printer. It is preferred that the outermost surface of the heat-sensitive transfer image-receiving sheet at the side of no receptive layer being formed is composed of a polymer layer containing inorganic fine-particles.

As the inorganic fine-particles of a polymer layer containing inorganic fine-particles, use can be made of publicly known inorganic fine-particles with specific examples including fine particles of silicon dioxide, aluminum oxide, colloidal silica, alumina sol, talc, mica, zinc stearate, and magnesium oxide. Preferred are fine particles of colloidal silica, alumina sol, talc, mica, zinc stearate, and magnesium oxide. A sphere-equivalent particle size of the inorganic fine-particles is preferably within the range from 0.005 μm to 50 μm, most preferably from 0.01 μm to 40 μm. Further, as the polymer of the polymer layer containing inorganic fine-particles, use can be made of publicly known polymers with specific examples including gelatin, a hardened gelatin with a hardener, starch, carboxymethyl cellulose, polyacrylamide, polyvinyl pyrrolidone, polyvinyl alcohol, a carboxyl group-modified material of polyvinyl alcohol, a silanol group-modified material of polyvinyl alcohol, a copolymer of polyvinyl alcohol and acrylamide, and a hardened polymer of acrylic polyol with a hardener. Preferred are polyacrylamide, polyvinyl alcohol, and a copolymer of polyvinyl alcohol and acrylamide. As the foregoing hardener, use can be made of publicly known hardeners. However, isocyanate-series hardeners can be preferably used.

Further, it is preferred to contain a solid or liquid organic lubricant in combination with the foregoing inorganic fine-particles in the outermost surface of the heat-sensitive transfer image-receiving sheet at the side opposite to the receptive layer. As the organic lubricants, use can be made of publicly known organic lubricants including various kinds of waxes such as stearic acid amide, carnauba wax, montan wax, polyethylene wax and paraffin wax, higher aliphatic acid alcohol, organopolysiloxane, anionic surfactants, cationic surfactants, amphoteric surfactants, nonionic surfactants, fluorine-series surfactants, organic carboxylic acids and their derivatives, fluorine-series resins, silicone-series resin, phosphate-series compounds and mats of organic fine-particles.

Further, it is preferred to contain an antistatic agent in order to prevent "getting caught" owing to static electricity. As the antistatic agent, use can be made of any antistatic agents exemplified by cationic antistatic agents such as quaternary ammonium salts and polyamine derivatives, anionic antistatic agents such as alkyl phosphate, and nonionic antistatic agents such as aliphatic acid esters.

Further, additives such as inorganic oxide colloid and ionic polymers may be used in order to give writing properties to the outermost surface. Specifically, such the writing property-providing outermost surface may be formed in the same manner as described in, for example, the specification of Japanese registered patent No. 3585585.

In the present invention, the heat-sensitive transfer image-receiving sheet is used in a printer, taking a form in which the image-receiving sheet is wound around the foregoing cardboard cylinder of the present invention in a roll form. The heat-sensitive transfer image-receiving sheet can be processed into a roll form by sticking the image-receiving sheet with an adhesive tape or the like on the outer surface of the cardboard cylinder so as to prevent said sheet from slipping, and thereafter winding the sheet around the cardboard cylinder. A perspective view in FIG. 1 shows a position relation of each of a cardboard cylinder, a heat-sensitive transfer image-receiving sheet wound on the cardboard cylinder and a shaft unit that is one of preferable embodiments of the present invention. In FIG. 1, notation 10 indicates a rolled heat-sensitive transfer image-receiving sheet to form a roll shape, 11 indicates a cardboard cylinder, 12 indicates a heat-sensitive transfer image-receiving sheet wound on the cardboard cylinder, 13 indicates a shaft, and 13*b* indicates an insertion section having a circular arc-like movable part 13*a* located at the outer surface of each of the shaft 13. Preferably, the shaft 13 is used in the state that the shaft unit has been forced into the inner surface of the cardboard cylinder 11 following the arrows.

The use of a cardboard cylinder according to the present invention enables to control a slip occurring at the time of printing between the innermost surface of the roll form and a shaft unit inserted into the roll form, even though a heat-sensitive transfer image-receiving sheet wound around the cardboard cylinder is lengthened, which results in a mass increase of rolled image-receiving sheet. Therefore, the cardboard cylinder of the present invention is also excellent in the point that a frequency of replacement for the rolled image-receiving sheet can be reduced. There exist a preferable range of both length and weight for the rolled heat-sensitive transfer image-receiving sheet from the consideration that the image-receiving sheet is desired to be lengthened as long as possible, but the length is limited by a capacity of the conveying motor used in the printer. Specifically, the length of the heat-sensitive transfer image-receiving sheet wound up in the roll shape is preferably within the range from 20 m to 200 m, most preferably from 40 m to 100 m. The weight of the rolled heat-sensitive transfer image-receiving sheet to form a roll shape is preferably within the range of 1.0 kg to 10 kg, most preferably from 1.5 kg to 8.0 kg.

1) Image Formation

In the image-forming method of the present invention, imaging is achieved by superposing a heat-sensitive transfer layer (i.e. a dye layer) of a heat-sensitive transfer sheet on a receptor layer of a heat-sensitive transfer image-receiving sheet, and giving thermal energy in accordance with image signal given from a thermal head.

Specifically, image-forming can be achieved by the similar manner to that as described in, for example, JP-A-2005-88545. In the present invention, a print production capacity is preferably 20 cm/min or more, more preferably 50 cm/min or more, in terms of linear speed from a viewpoint of high speed print. A printing time is preferably less than 15 seconds, more preferably in the range of from 3 to 12 seconds, and further preferably in the range of from 3 to 7 seconds, per one sheet of print.

According to the high speed print, a heat-sensitive transfer sheet is moved at higher speed in a printer, so that greater torque is loaded between the rolled heat-sensitive transfer image-receiving sheet and a shaft unit. In the present invention, it is preferred for the high speed print that no slip occurs even though 35N or more of torque is loaded between the rolled heat-sensitive transfer image-receiving sheet and a shaft unit. It is more preferred that no slip occurs even though 40N or more of torque is loaded between them.

In the present invention, it is preferable for the high speed print that a surface of the heat-sensitive transfer image-receiving sheet opposite to the receptive layer side is not caught during print.

For the forgoing reason, coefficient of static friction (i.e. that of the surface of the heat-sensitive transfer image-receiving sheet opposite to the receptive layer side) is preferably 0.25 or less, and more preferably in the range of from 0.15 to 0.23. If the coefficient of static friction is small, sometimes roll shearing occurs in the rolled heat-sensitive transfer image-receiving sheet. Therefore, it is sometimes preferred that a certain degree of static friction exists. Coefficient of dynamic friction (i.e. that of the surface of the heat-sensitive transfer image-receiving sheet opposite to the receptive layer side) is preferably 0.22 or less, and more preferably in the range of from 0.10 to 0.20.

In the present invention, it is preferable to print with a thermal head by transferring an ink from a heat transfer layer, at a speed of 100 mm/second or more, most preferably of 110 mm/second or more.

The line speed of the thermal head during printing is preferably 1.0 milliseconds/line or less, more preferably 0.8 milliseconds/line or less, and most preferably 0.65 milliseconds/line or less. Further, the maximum ultimate temperature of the thermal head at the time of printing is preferably in the range of from 180° C. to 450° C., more preferably from 200° C. to 450° C., and furthermore preferably from 350° C. to 450° C.

The cardboard cylinder and the rolled heat-sensitive transfer image-receiving sheet to form a roll shape according to the present invention can be applied to a printer, a copying machine and the like using a heat-sensitive transfer recording system. Any known energy-providing means may be used as the means for providing heat energy during heat-sensitive transfer, for example, in low-speed printing machines such as Video Printer VY-100 (trade name, manufactured by Hitachi) and also in high-speed printing machines such as ASK2000 (trade name, manufactured by Fuji Photo Film Co., Ltd.). The present invention provides remarkable effects when used for high speed print. As a matter of course, the present invention can be also used for low speed print. It is also possible to apply the heat-sensitive transfer sheet according to the present invention to various applications such as reflective print, cards, and transparent print, by properly selecting the support of the heat-sensitive transfer image-receiving sheet.

2) Heat-sensitive Transfer Image-receiving Sheet

The heat-sensitive transfer image-receiving sheet (hereinafter also referred to as an image-receiving sheet) will be explained bellow.

The heat-sensitive transfer image-receiving sheet that can be used in the present invention is provided with at least one dye-receiving layer (receptor layer) on a support, and at least one heat insulation layer (porous layer) between the support and the receptor layer. Moreover, an undercoat layer, such as a white-background-control layer, a charge-control layer, an adhesive layer, and a primer layer, may be provided between the receptor layer and the heat insulation layer.

The receptor layer and the heat insulation layer are preferably formed by a simultaneous multi-layer coating. When the undercoat layer is provided, the receptor layer, the undercoat layer and the heat insulation layer may be formed by the simultaneous multi-layer coating.

It is preferable that a curling control layer, a writing layer, or a charge-control layer be formed on the backside of the support. Each of these layers on the backside of the support may be applied using a usual method such as a roll coating, a bar coating, a gravure coating and a gravure reverse coating.

<Receptor Layer>

[Thermoplastic Resin]

In the present invention, a thermoplastic resin is preferably used in the receptor layer. Examples of the thermoplastic resin that is preferably used in the receptor layer in the present invention include halogenated polymers such as polyvinyl chloride and polyvinylidene chloride, vinyl series resins such as polyvinyl acetate, ethylene-vinyl acetate copolymer, vinyl chloride/vinyl acetate copolymer, polyacrylic ester, polystyrene and polystyrene acrylate, acetal-series resins such as polyvinylformal, polyvinylbutyral and polyvinylacetal, polyester-series resins such as polyethylene terephthalate, polybutylene terephthalate and polycaprolactone (e.g., PLACCEL H-5 (trade name) manufactured by Daicel Chemical Industries, Ltd.), polycarbonate-series resins, cellulose-series resins such as those described in JP-A-4-296595 and JP-A-2002-264543, cellulose-series resins such as cellulose acetate butyrate (e.g., CAB551-0.2 and CAB321-0.1 (each trade name) manufactured by Eastman Chemical Company)), polyolefin-series resins such as polypropylene and polyamide-series resins such as urea resins, melamine resins and benzoguanamine resins. These resins may be used optionally blending with each other in the range of compatibility. Resins used for forming the receptor layer are also disclosed in JP-A-57-169370, JP-A-57-207250 and JP-A-60-25793.

It is further preferable, among these polymers, to use a polycarbonate, a polyester, a polyurethane, a polyvinyl chloride or its copolymer, a styrene-acrylonitrile copolymer, a polycaprolactone or a mixture of two or more of these. It is particularly preferable to use a polycarbonate, a polyester, a polyvinyl chloride or its copolymer or a mixture of two or more of these. The following is a more detailed explanation of a polycarbonate, a polyester and a polyvinyl chloride. These polymers may be used singly or as mixtures thereof.

(Polyester Polymers)

The polyester polymer that can be used in the receptor layer in the present invention is explained in more detail. The polyester polymers are obtained by polycondensation of a dicarboxylic acid component (including a derivative thereof) and a diol component (including a derivative thereof). The polyester polymers preferably contain an aromatic ring and/or an alicyclic ring. As to technologies related to the alicyclic polyester, those described in JP-A-5-238167 are useful from the viewpoint of ability to incorporate a dye and image stability.

Examples of the dicarboxylic acid component include adipic acid, azelaic acid, isophthalic acid, trimellitic acid, terephthalic acid, 1,4-cyclohexane dicarboxylic acid and a mixture of two or more of these acids. The dicarboxylic acid component is preferably isophthalic acid, trimellitic acid, terephthalic acid or a mixture of two or more of these acids. From a viewpoint of improvement in light resistance, a dicarboxylic acid component having an alicyclic structure is more preferable as the dicarboxylic acid component. The dicarboxylic acid component is further preferably 1,4-cyclohexane dicarboxylic acid or isophthalic acid. Specifically, as the dicarboxylic acid component, a mixture of isophthalic acid in an amount of 50 to 100 mol %, trimellitic acid in an amount of 0 to 1 mol %, terephthalic acid in an amount of 0 to 50 mol %, and 1,4-cyclohexane dicarboxylic acid in an amount of 0 to 15 mol %, in which a total amount of these components is 100 mol %, is furthermore preferably used.

Examples of the diol component include ethylene glycol, polyethylene glycol, tricyclodecane dimethanol, 1,4-butanediol, bisphenol and a mixture of two or more of these diols. The diol component is preferably ethylene glycol, polyethylene glycol or tricyclodecane dimethanol. From a viewpoint of improvement in light resistance, a diol component having an alicyclic structure is more preferable as the diol component. Use can be made of an alicyclic diol component such as cyclohexanediol, cyclohexanedimethanol and cyclohexanediethanol, in addition to tricyclodecane dimethanol. The alicyclic diol component is preferably tricyclodecane dimethanol. Specifically, as the diol component, a mixture of ethylene glycol in an amount of 0 to 50 mol %, polyethylene glycol in an amount of 0 to 10 mol %, tricyclodecane dimethanol in an amount of 0 to 90 mol % (preferably from 30 to 90 mol %, more preferably from 40 to 90 mol %), 1,4-butanediol in an amount of 0 to 50 mol % and bisphenol A in an amount of 0 to 50 mol %, in which a total amount of these components is 100 mol %, is furthermore preferably used.

In the present invention, as the polyester polymers, it is preferable to use polyester polymers obtained by polycondensation using at least one of the above-described dicarboxylic acid component and at least one of the above-described diol component, so that the thus-obtained polyester polymers could have a molecular weight (mass average molecular weight (Mw)) of generally about 11,000 or more, preferably about 15,000 or more, and more preferably about 17,000 or more. If polyester polymers of too low molecular weight are used, elastic coefficient of the formed receptor layer becomes low and also it raises lack of thermal resistance. Resultantly, it sometimes becomes difficult to assure the releasing property of the heat-sensitive transfer sheet and the image-receiving sheet. A higher molecular weight is more preferable from a viewpoint of increase in elastic coefficient. The molecular weight is not limited in particular, so long as such failure does not occur that a higher molecular weight makes the polymer difficult to be dissolved in a solvent for a coating solution at the time of forming the receptor layer, or that an adverse effect arises in adhesive properties of the receptor layer to a substrate sheet after coating and drying the receptor layer. However, the molecular weight is preferably about 25,000 or less, and at highest a degree of about 30,000. The polyester polymers may be synthesized according to a known method.

Examples of a saturated polyester used as the polyester polymers, include VYLON 200, VYLON 290 and VYLON 600 (each trade name, manufactured by Toyobo Co., Ltd.), KA-1038C (trade name, manufactured by Arakawa Chemical Industries, Ltd.), and TP220 and TP235 (each trade name, manufactured by The Nippon Synthetic Chemical Industry Co., Ltd.).

(Polycarbonate-based Polymers)

The polycarbonate-series polymer that can be used in the receptor layer in the present invention is explained in more detail. The polycarbonate polymers mean a polyester composed of a carbonic acid and a diol as a unit. The polycarbonate polymers can be synthesized by, for example, a method in which a diol and a phosgene are reacted or a method in which a diol and a carbonic acid ester are reacted.

Examples of the diol component include bisphenol A, ethylene glycol, propylene glycol, diethylene glycol, butanediol, pentanediol, hexanediol, 1,4-cyclohexanedimethanol, nonanediol, 4,4'-bicyclo(2,2,2,)hepto-2-ylidene bisphenol, 4,4'-(octahydro-4,7-methano-5H-indene-5-ylidene)bisphenol and 2,2',6,6'-tetrachloro bisphenol A. Preferred are bisphenol A, ethylene glycol, diethylene glycol, butanediol and pentanediol. More preferred are bisphenol A, ethylene glycol and butanediol. Especially preferred are bisphenol A and ethylene glycol. As for the polycarbonate polymers used in the present invention, at least one of the above-described diol components is used. A plurality of diols may be used as a mixture thereof.

The following is a detailed explanation of a bisphenol A-polycarbonate that is an especially preferred embodiment.

Technologies related to unmodified polycarbonates that center around the bisphenol A-polycarbonate are described in U.S. Pat. No. 4,695,286. The polycarbonate polymers that can be used in the present invention are a polycondensation compounds having a molecular weight (weight average molecular weight (Mw)) of generally about 1,000 or more, preferably about 3,000 or more, more preferably about 5,000 or more, and especially preferably about 10,000 or more. Specific examples of the polycarbonate polymers include Makrolon-5700 (trade name, manufactured by Bayer AG) and LEXAN-141 (trade name, manufactured by General Electric Corporation).

Technologies of producing modified polycarbonates by mixing bisphenol A with a diol such as ethylene glycol are described in U.S. Pat. No. 4,927,803. The polyether block unit may be produced from a linear aliphatic diol having 2 to about 10 carbon atoms. But, a polyether block unit produced from ethylene glycol is preferred. In a preferred embodiment of the present invention, the polyether block unit has a number average molecular weight of about 4,000 to about 50,000, while the bisphenol A-polycarbonate block unit has a number average molecular weight of about 15,000 to about 250,000. A molecular weight of the whole block copolymer is preferably in the range of about 30,000 to about 300,000. Specific examples thereof include Makrolon KL3-1013 (trade name, manufactured by Bayer AG).

It is also preferable that these unmodified and modified bisphenol A-polycarbonates are mixed together. Specifically, it is preferred to blend an unmodified bisphenol A-polycarbonate with a polyether-modified polycarbonate in a ratio by mass of from 80:20 to 10:90. The ratio by mass of from 50:50 to 40:60 is especially preferred from a viewpoint of improvement in resistance to finger print. Technologies of blending the unmodified and modified bisphenol A-polycarbonates are also described in JP-A-6-227160.

As for a preferable embodiment of the thermoplastic resin used in the receptor layer, use can be made of a blend of the above-described polycarbonate polymers and the above-described polyester polymers. In the blend, it is preferred to secure compatibility of the polycarbonate polymers and the polyester polymers. The polyester polymers preferably have a glass transition temperature (Tg) of about 40° C. to about 100° C., and the polycarbonate polymers preferably have a Tg of about 100° C. to about 200° C. It is preferable that the polyester polymers have a Tg lower than that of the polycarbonate polymers and act as a plasticizer to the polycarbonate polymers. A preferable Tg of a finished polyester/polycarbonate blend is in the range of 40° C. to 100° C. Even though a polyester/polycarbonate blend polymer has a higher Tg, it may be used advantageously by addition of a plasticizer.

In a further preferable embodiment, an unmodified bisphenol A-polycarbonate and polyester polymers are blended in such a ratio by mass that a Tg of the finished blend not only becomes a preferable value but also a cost can be controlled to the minimum. The polycarbonate polymers and the polyester polymers can be blended advantageously in a ratio by mass of approximately from 75:25 to 25:75. It is more preferable to blend them in a ratio by mass of from about 60:40 to about 40:60. Technologies of a blend series of the polycarbonate polymers and the polyester polymers are disclosed in JP-A-6-227161.

As for the polycarbonate polymers used in the receptor layer, a net structure of a crosslinked polymer may be formed in the receptor layer by subjecting a polycarbonate having an average molecular weight of about 1,000 to about 10,000, the ends of which have at least 2 hydroxyl groups, to react with a crosslinking agent capable of reacting with the hydroxyl groups. As described in JP-A-6-155933, there are known technologies for a crosslinking agent such as a multifunctional isocyanate, thereby to improve adhesiveness to a dye donator after transfer. Further, as the technologies disclosed in JP-A-8-39942, there are technologies in which a receiving sheet for a heat-sensitive dye transfer process is constructed using dibutyl tin diacetate at a time of crosslinking reaction of a polycarbonate with isocyanate. Such technologies enable to improve not only acceleration of the crosslinking reaction, but also image stability, resistance to finger print, and the like.

(Vinyl Chloride-series Polymers)

The vinyl chloride-series polymers, particularly a copolymer using vinyl chloride, used in the receptor layer are explained in more detail.

The polyvinyl chloride-series copolymer is preferably one having a vinyl chloride constituent content of 85 to 97% by mass and a polymerization degree of 200 to 800. A monomer forming such a copolymer together with vinyl chloride has no particular restrictions, and any monomer may be used as far as it can be copolymerized with vinyl chloride. However, it is particularly preferably vinyl acetate. Accordingly, the polyvinyl chloride copolymer used in the receptor layer is advantageously a vinyl chloride/vinyl acetate copolymer. However, the vinyl chloride/vinyl acetate copolymer is not necessarily constituted of, only, vinyl chloride and vinyl acetate, but it may include a vinyl alcohol unit or a maleic acid unit to an extent to which the effects of the present invention would be obtained. Examples of other monomer constituents of such a copolymer constituted mainly of vinyl chloride and vinyl acetate include vinyl alcohol and its derivatives such as vinyl propionate; acrylic or methacrylic acids and their derivatives such as their methyl, ethyl, propyl, butyl and 2-ethylhexyl esters; maleic acid and its derivatives such as diethyl maleate, dibutyl maleate and dioctyl maleate; vinyl ether derivatives such as methyl vinyl ether, butyl vinyl ether and 2-ethylhexyl vinyl ether; acrylonitrile and methacrylonitrile; and styrene. The ratio of each of the vinyl chloride and vinyl acetate components in the copolymer may be any ratio, but it is preferable that the ratio of the vinyl chloride component is 50 mass % or more of the copolymer. In addition, it is preferable that the ratio of the above-recited constituents other than the vinyl chloride and vinyl acetate is 10 mass % or less of the copolymer.

Examples of such a vinyl chloride/vinyl acetate copolymer include SOLBIN C, SOLBIN CL, SOLBIN CH, SOLBIN CN, SOLBIN C5, SOLBIN M, SOLBIN MF, SOLBIN A, SOLBIN AL, SOLBIN TA5R, SOLBIN TAO, SOLBIN MK6, and SOLBIN TA2 (trade names, manufactured by Nissin Chemical Industry Co., Ltd.); S-LEC A, S-LEC C and S-LEC M (trade names, manufactured by Sekisui Chemical Co., Ltd.); Vinylite VAGH, Vinylite VYHH, Vinylite VMCH, Vinylite VYHD, Vinylite VYLF, Vinylite VYNS, Vinylite VMCC, Vinylite VMCA, Vinylite VAGD, Vinylite VERR and Vinylite VROH (trade names, manufactured by Union Carbide Corporation); and DENKA VINYL 1000GKT, DENKA VINYL 1000L, DENKA VINYL 1000CK, DENKA VINYL 1000A, DENKA VINYL 1000LK2, DENKA VINYL 1000AS, DENKA VINYL 1000MT2, DENKA VINYL 1000CSK, DENKA VINYL 1000CS, DENKA VINYL 1000GK, DENKA VINYL 1000GSK, DENKA VINYL 1000GS, DENKA VINYL 1000LT3, DENKA VINYL 1000D and DENKA VINYL 1000W (trade names, manufactured by Denki Kagaku Kogyo Kabushiki Kaisha).

(Latex Polymer)

In the present invention, other than the aforementioned polymers, latex polymers can also be preferably used. Hereinafter, the latex polymer will be explained.

In the heat-sensitive transfer image-receiving sheet that can be used in the present invention, the latex polymer used in the receptor layer is a dispersion in which hydrophobic polymers comprising a monomer unit of water-insoluble vinyl chloride are dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean particle size (diameter) of about 1 to 50,000 nm, more preferably about 5 to 1,000 nm.

The particle size distribution of the dispersed particles is not particularly limited, and the particles may have either wide particle-size distribution or monodispersed particle-size distribution.

The latex polymer that can be used in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer that can be used in the present invention is preferably −30° C. to 100° C., more preferably 0° C. to 80° C., further more preferably 10° C. to 70° C., and especially preferably 15° C. to 60° C.

In the present invention, as a preferable embodiment of the latex polymer used in the receptor layer, use can be made of polyvinyl chlorides, a copolymer comprising vinyl chloride unit, such as a vinyl chloride/vinyl acetate copolymer and a vinyl chloride-acrylate copolymer. In this case, the vinyl chloride unit in molar ratio is preferably in the range of from 50% to 95%. These polymers may be straight-chain, branched or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number average molecular weight. Polymers having excessively small molecular weight impart insufficient dynamic strength to the layer containing the latex, and polymers having excessively large molecular weight bring about poor filming ability. Crosslinkable latex polymers are also preferably used.

The latex polymer that can be used in the present invention is commercially available, and polymers described below may be utilized. Examples thereof include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (trade names, manufactured by Nissin Chemical Industry Co., Ltd.).

These latex polymers may be used singly, or two or more of these polymers may be blended, if necessary.

In the receptor layer, a ratio of the latex polymer comprising a component of vinyl chloride is preferably 50 mass % or more of the whole solid content in the layer.

In the present invention, it is preferable to prepare the receptor layer by applying an aqueous type coating solution and then drying it. The so-called "aqueous type" here means that 60% by mass or more of the solvent (dispersion medium) of the coating solution is water. As a component other than water in the coating solution, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether and oxyethyl phenyl ether.

The latex polymer that can be used in the present invention preferably has a minimum film-forming temperature (MFT) of from −30 to 90° C., more preferably from 0 to 70° C. In order to control the minimum film-forming temperature, a film-forming aid may be added. The film-forming aid is also called a temporary plasticizer, and it is an organic compound (usually an organic solvent) that reduces the minimum film-forming temperature of a latex polymer. It is described in, for example, Souichi Muroi, "Gosei Latex no Kagaku (Chemistry of Synthetic Latex)", issued by Kobunshi Kanko Kai (1970). Preferable examples of the film-forming aid are listed below, but the compounds that can be used in the present invention are not limited to the following specific examples.

Z-1: Benzyl alcohol
Z-2: 2,2,4-Trimethylpentanediol-1,3-monoisobutyrate
Z-3: 2-Dimethylaminoethanol
Z-4; Diethylene glycol The latex polymer that can be used in the present invention may be used (blended) with another latex polymer. Preferable examples of the another latex polymer include polylactates, polyurethanes, polycarbonates, polyesters, polyacetals, and SBR's. Among these, polyesters and polycarbonates are preferable.

In combination with the above-described latex polymer that can be used in the present invention, any polymer can be used. The polymer that can be used in combination is preferably transparent or translucent, and colorless. The polymer may be a natural resin, polymer, or copolymer; a synthetic resin, polymer, or copolymer; or another film-forming medium; and specific examples include gelatins, polyvinyl alcohols, hydroxyethylcelluloses, cellulose acetates, cellulose acetate butyrates, polyvinylpyrrolidones, caseins, starches, polyacrylic acids, poly methyl methacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, and polyamides. A binder may be dissolved or dispersed in water, an aqueous solvent or an organic solvent, or may be in the form of an emulsion.

The glass transition temperature (Tg) of the binder that can be used in the present invention is preferably in the range of −30° C. to 70° C., more preferably −10° C. to 50° C., still more preferably 0° C. to 40° C., in view of film-forming properties (brittleness for working) and image preservability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The glass transition temperature (Tg) is calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer ($\Sigma Xi=1$) and Tgi is glass transition temperature (measured in absolute temperature) of a homopolymer formed from the i-th monomer. The symbol Σ means the sum of i=1 to i=n. The value of the glass transition temperature of a homopolymer formed from each monomer (Tgi) can be adopted from J. Brandrup and E. H. Immergut, "Polymer Handbook, 3rd. Edition", Wiley-Interscience (1989).

The polymer used for the binder in the present invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Further, a method is preferable in which the polymer is prepared in a solution, and the solution is neutralized or an emulsifier is added to the solution, to which water is then added, to prepare an aqueous dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature and the method for adding monomers are suitably determined considering the type of the monomers to be used. Furthermore, it is preferable to use a dispersant when necessary.

In the coating solution of the latex polymer to be used in the present invention, an aqueous solvent can be used as the solvent, and a water-miscible organic solvent may optionally be used in combination. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 50 mass % or less of the entire solvent, more preferably 30 mass % or less of the entire solvent.

Furthermore, in the latex polymer to be used in the present invention, the polymer concentration is, based on the amount of the latex liquid, preferably 10 mass % to 70 mass %, more preferably 20 mass % to 60 mass %, and especially preferably 30 mass % to 55 mass %.

The latex polymer in the image-receiving sheet that can be used in the present invention includes a state of a gel or dried film formed by removing a part of solvents by drying after coating.

[Emulsified Dispersion]

In the present invention, incorporation of an emulsified dispersion (emulsion) in the receptor layer is preferable, especially when the latex polymer is used.

The term "emulsification" as used herein follows the commonly used definition. According to "Kagaku Daijiten (ENCYCLOPEDIA CHIMICA)", Kyoritsu Shuppan Co., Ltd., for example, "emulsification" is defined as "a phenomenon in which, in one liquid, another liquid which does not dissolve in the first liquid are dispersed as fine globules, to form an emulsion". In addition, the term "emulsified dispersion" refers to "a dispersion in which fine globules of one liquid are dispersed in another liquid which does not dissolve the globules". The "emulsified dispersion" preferred in the present invention is "a dispersion of oil globules in water". The content of an emulsified dispersion in the image-receiving sheet that can be used in the present invention is preferably from 0.03 g/m$^2$ to 25.0 g/m$^2$, more preferably from 1.0 g/m$^2$ to 20.0 g/m$^2$.

In the present invention, it is preferable that a high-boiling solvent be included as an oil-soluble substance in the emulsified dispersion. Examples of the high-boiling solvent preferably used include phthalic acid esters (such as dibutyl phthalate, dioctyl phthalate, and di-2-ethyl-hexyl phthalate), phosphoric or phosphonic acid esters (such as triphenyl phosphate, tricresyl phosphate, tri-2-ethylhexyl phosphate), fatty acid esters (such as di-2-ethylhexyl succinate and tributyl citrate), benzoic acid esters (such as 2-ethylhexyl benzoate and dodecylbenzoate), amides (such as N,N-diethyldodecanamide and N,N-dimethyloleinamide), alcohol and phenol compounds (such as isostearyl alcohol and 2,4-di-tert-amylphenol), anilines (such as N,N-dibutyl-2-butoxy-5-tert-octylaniline), chlorinated paraffins, hydrocarbons (such as dodecylbenzene and diisopropylnaphthalene), and carboxylic acids (such as 2-(2,4-di-tert-amylphenoxy)butyric acid). Of these high-boiling solvents, phosphoric or phosphonic acid esters (such as triphenyl phosphate, tricresyl phosphate, and tri-2-ethylhexyl phosphate) are preferred over the others. In addition to such a high-boiling solvent, an organic solvent having a boiling point of 30° C. to 160° C. (such as ethyl acetate, butyl acetate, methyl ethyl ketone, cyclohexanone, methyl cellosolve acetate, or dimethylformamide) may be used as an auxiliary solvent. The content of high-boiling solvent in the emulsified dispersion is preferably from 3.0 to 25% by mass, and more preferably from 5.0 to 20% by mass.

It is preferable that the emulsified dispersion further contain an agent for imparting fastness to images and an ultraviolet absorbent. The compounds preferably used as such agents are any of the compounds represented by formulae (B), (Ph), (E-1) to (E-3), (TS-I) to (TS-VII), (TS-VIIIA), (UA) to (UE) disclosed in JP-A-2004-361936. Further, homopolymers or copolymers insoluble in water and soluble in organic solvents (preferably the compounds disclosed in JP-A-2004-361936, paragraph Nos. 0208 to 0234) may be included therein.

[Plasticizer]

For the purpose of enhancing the sensitivity of the receptor layer, a plasticizer (high boiling organic solvent) may also be added. Examples of such a plasticizer include compounds generally used as plasticizers for vinyl chloride resins, and more specifically monomeric plasticizers such as phthalates, phosphates, adipates and sebacates, and polyester-type plasticizers produced by polymerization of adipic acid or sebacic acid and propylene glycol. Although the former plasticizers are generally low in molecular weight, olefin-type special copolymer resins, which are used as polymeric plasticizer usable for vinyl chloride, may also be used. Examples of resins usable for such a purpose include products marketed under the names of ELVALOY 741, ELVALOY 742, ELVALOY HP443, ELVALOY HP553, ELVALOY EP4015, ELVALOY EP4043, ELVALOY EP4051 (trade names, manufactured by DuPont-Mitsui Polychemicals Co., Ltd.). Such plasticizers can be added to the resins in a proportion of about 100% by mass based on the resin in the receptor layer, but it is appropriate to use them in a proportion of 30% by mass or below in view of bleeding of prints. When the latex polymer is used, it is preferable that those plasticizers be used in a state of the emulsified dispersion as mentioned above.

The receptor layer that can be used in the present invention can be cast by extrusion coating of a melt of the polymer resin as recited above without resorting to solvent coating. The techniques of this extrusion coating are described in *Encyclopedia of Polymer Science and Engineering*, vol. 3, p. 563, John Wiley, New York (1985), and *ibid.*, vol. 6, p. 608 (1986). In addition, the technique for heat-sensitive dye transfer materials is disclosed in JP-A-7-179075, and it is also preferably applicable to the present invention. As the polymer resin, copolymer obtained by condensing cyclohexane dicarboxylate and a 50:50 by mole % mixture of ethylene glycol and bisphenol-A-diethanol (COPOL; registered trade mark) is especially preferred.

[Releasing Agent]

If the image-receiving surface of the heat-sensitive transfer image-receiving sheet lacks a sufficient releasing property, problems of so-called abnormal transfer arises. Examples of the abnormal transfer include a problem that a heat-sensitive transfer sheet and a heat-sensitive transfer image-receiving sheet mutually weld by heat from a thermal head for the image-forming, and thereby a big noise due to peeling arises at the time of peeling; a problem that a dye layer is entirely transferred; and a problem that the receptor layer is peeled from the support. As a method of solving such problems of releasing property, there are known a method of introducing various kinds of releasing agents (lubricant) in the receptor layer and a method of disposing a releasing layer additionally on the receptor layer. In the present invention, it is preferable to use a releasing agent in the receptor layer in order to keep more securely the releasing property between the heat-sensitive transfer sheet and the image-receiving sheet at the time of printing images.

As the releasing agent, solid waxes such as polyethylene wax, amide wax and Teflon® powder; silicone oil, phosphate-series compounds, fluorine-based surfactants, silicone-based surfactants and others including releasing agents known in the technical fields concerned may be used. Among these, fluorine-series compounds typified by fluorine-based surfactants, silicone-based surfactants and silicone-series compounds such as silicone oil and/or its hardened products are preferably used.

As the silicone oil, straight silicone oil and modified silicone oil or their hardened products may be used. Examples of the straight silicone oil include dimethylsilicone oil, methylphenylsilicone oil and methyl hydrogen silicone oil. Examples of the dimethylsilicone oil include KF96-10, KF96-100, KF96-1000, KF96H-10000, KF96H-12500 and KF96H-100000 (all of these names are trade names, manufactured by Shin-Etsu Chemical Co., Ltd.). Examples of the methylphenylsilicone oil include KF50-100, KF54 and KF56 (all of these names are trade names, manufactured by Shin-Etsu Chemical Co., Ltd.).

The modified silicone oil may be classified into reactive silicone oils and non-reactive silicone oils. Examples of the reactive silicone oils include amino-modified, epoxy-modified, carboxyl-modified, hydroxy-modified, methacrylic-modified, mercapto-modified, phenol-modified or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (all of these names are trade names, manufactured by Shin-Etsu Chemical Co., Ltd.). Examples of the epoxy-modified silicone oil include KF-100T, KF-101, KF-60-164, KF-103, X-22-343 and X-22-3000T (all of these names are trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (all of these names are trade names, manufactured by Shin-Etsu Chemical Co., Ltd.). Examples of the methacrylic-modified silicone oil include X-22-164A, X-22-164C, X-24-8201, X-22-174D and X-22-2426 (all of these names are trade names, manufactured by Shin-Etsu Chemical Co., Ltd.).

Reactive silicone oils may be hardened upon use, and may be classified into a reaction-curable type, photocurable type, catalyst-curable type, and the like. Among these types, silicone oil that is the reaction-curable type is particularly preferable. As the reaction-curable type silicone oil, products obtained by subjecting an amino-modified silicone oil to react with an epoxy-modified silicone oil and then by curing are preferable. Further, examples of the catalyst-curable type or photocurable type silicone oil include KS-705F-PS, KS-705F-PS-1 and KS-770-PL-3 (all of these names are trade names, catalyst-curable silicone oils, manufactured by Shin-Etsu Chemical Co., Ltd.) and KS-720 and KS-774-PL-3 (all of these names are trade names, photocurable silicone oils, manufactured by Shin-Etsu Chemical Co., Ltd.). The addition amount of the curable type silicone oil is preferably 0.5 to 30% by mass based on the resin constituting the receptor layer. The releasing agent is used preferably in an amount of 2 to 4% by mass and further preferably 2 to 3% by mass based on 100 parts by mass of the polyester resin. If the amount is too small, the releasability cannot be secured without fail, whereas if the amount is excessive, a protective layer is not transferred to the image-receiving sheet resultantly.

Examples of the non-reactive silicone oil include polyether-modified, methylstyryl-modified, alkyl-modified, higher fatty acid ester-modified, hydrophilic special-modified, higher alkoxy-modified or fluorine-modified silicone oils. Examples of the polyether-modified silicone oil include KF-6012 (trade name, manufactured by Shin-Etsu Chemical Co., Ltd.) and examples of the methylstyryl-modified silicone oil include 24-510 (trade name, manufactured by Shin-Etsu Chemical Co., Ltd.). Modified silicones represented by any one of the following Formulae 1 to 3 may also be used.

Formula 1

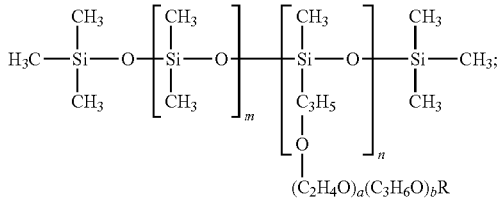

Formula 2

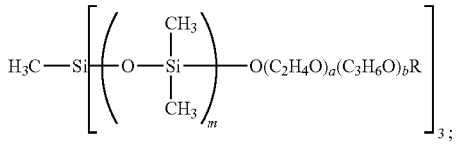

Formula 3

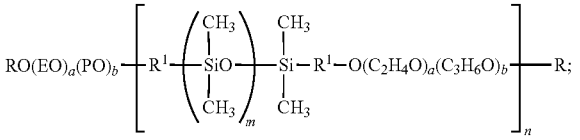

In the Formula 1, R represents a hydrogen atom or a straight-chain or branched alkyl group which may be substituted with an aryl or cycloalkyl group. m and n respectively denote an integer of 2,000 or less, and a and b respectively denote an integer of 30 or less.

In the Formula 2, R represents a hydrogen atom or a straight-chain or branched alkyl group which may be substituted with an aryl or cycloalkyl group. m denotes an integer of 2,000 or less, and a and b respectively denote an integer of 30 or less.

In the Formula 3, R represents a hydrogen atom or a straight-chain or branched alkyl group which may be substituted with an aryl or cycloalkyl group. m and n respectively denote an integer of 2,000 or less, and a and b respectively denote an integer of 30 or less. $R^1$ represents a single bond or a divalent linking group, E represents an ethylene group which may be further substituted, and P represents a propylene group which may be further substituted.

Silicone oils such as those mentioned above are described in "SILICONE HANDBOOK" (The Nikkan Kogyo Shimbun, Ltd.) and the technologies described in each publication of JP-A-8-108636 and JP-A-2002-264543 may be preferably used as the technologies to cure the curable type silicone oils.

In some cases, a dye binder is transferred to the receptor layer in a highlight portion of monochrome printing, to cause an irregular transfer. In addition, it is known that an addition polymerization-type silicone generally progresses a hardening reaction in the presence of a catalyst, and that almost all of complexes of transition metal of VIII group, such as Fe group and Pt group, are effective as the hardening catalyst. Among these, a platinum compound has the highest efficiency in general, and a platinum catalyst, which is generally a platinum complex soluble in the silicone oil, is preferably used. Generally, the addition amount for the reaction is sufficiently about 1 to 100 ppm.

This platinum catalyst has a strong interaction with an organic compound containing an element such as N, P and S, an ionic compound of heavy metal such as Sn, Pb, Hg, Bi and As, or an organic compound containing a polyvalent bond such as an acetylene group. Therefore, if the above-described compounds (catalyst poison) are used together with the platinum catalyst, the ability of the catalyst to hydrosilylate is lost. Resultantly, the platinum catalyst cannot work as the hardening catalyst. Therefore, a problem arises that the platinum catalyst causes silicone to lack in hardening ability, when used with such a catalyst poison (See "Silicone Handbook" published by Nikkan Kogyo Shunbun shya). As a result, such an addition polymerization-type silicone causing such a hardening failure cannot show a releasability needed, when it is used in the receptor layer. As a hardener reacting with an active hydrogen, it is considered to use an isocyanate compound. However, this isocyanate compound and an organic tin compound working as a catalyst to the isocyanate compound act as a catalyst poison to the platinum catalyst. Therefore, the addition polymerization-type silicone has never been used together with the isocyanate compound in the past. Resultantly, the addition polymerization-type silicone has never been used together with a modified silicone having an active hydrogen that shows a releasability needed when hardened with the isocyanate compound.

However, the hardening failure of the addition polymerization-type silicone can be prevented by 1) setting an equivalent amount of the reactive group of the hardener capable of reacting with the active hydrogen, to the reactive group of both the thermoplastic resin and the modified silicone having an active hydrogen, in the range of from 1:1 to 10:1, and 2) setting an addition amount of the platinum catalyst based on the addition polymerization-type silicone in the range of 100 to 10,000 ppm in terms of platinum atom of the platinum catalyst. If the equivalent amount of the reactive group of the hardener capable of reacting with the active hydrogen according to the 1) described above is too small, an amount of silicone having an active hydrogen hardened with an active hydrogen of the thermoplastic resin is so small that an excellent releasability needed cannot be achieved. On the other hand, if the equivalent ratio is too large, a time which is allowed to use an ink in a coating solution for the receptor layer is so short that such the equivalent ratio cannot be substantially applied to the present invention. Further, if the addition amount of the platinum catalyst according to the 2) described above is too small, activity is lost by the catalyst poison, whereas if the addition amount is too large, a time which is allowed to use an ink in a coating solution for the receptor layer is so short that such the addition amount cannot be substantially applied to the present invention.

In the present invention, the amount of the receptor layer to be applied is preferably 0.5 to 10 g/m$^2$ (solid basis, hereinafter, the amount to be applied in the present specification is a value on solid basis unless otherwise noted).

<Releasing Layer>

In the case where the hardened modified silicone oil is not added to the receptor layer, the silicone oil may be added to a releasing layer provided on the receptor layer. In this case, the receptor layer may be provided using at least one of the above-described thermoplastic resins. Besides, a receptor layer to which silicone is added may be used. The releasing layer contains a hardened modified silicone oil. A kind of the silicone to be used and a method of using the silicone are the same as for use in the receptor layer. Further, in the case where a catalyst or a retardant is used, the above described descriptions related to addition of these additives to the receptor layer may be applied. The releasing layer may be formed using only a silicone, or alternatively a mixture of a silicone and a binder resin having a good compatibility therewith. A thickness of the releasing layer is generally in the range of about 0.001 to about 1 g/m$^2$.

Examples of the fluorine surfactants include Fluorad FC-430 and FC-431 (trade names, manufactured by 3M).

<Heat Insulation Layer>

A heat insulation layer serves to protect the support from heat when a thermal head or the like is used to carry out a transfer operation under heating. Further, because the heat insulation layer generally has proper cushion characteristics, a heat-sensitive transfer image-receiving sheet having high printing sensitivity can be obtained even in the case of using paper as a support. The heat insulation layer may be a single layer, or multi-layers. The heat insulation layer is generally arranged at a nearer location to the support than the receptor layer.

In the image-receiving sheet of the present invention, the heat insulation layer contains hollow polymer particles.

The hollow polymer particles in the present invention are polymer particles having independent pores inside of the particles. Examples of the hollow polymer particles include (1) non-foaming type hollow particles obtained in the following manner: a dispersion medium, such as water, is contained inside of a capsule wall formed of a polystyrene, acrylic resin, or styrene/acrylic resin, and, after a coating solution is applied and dried, the dispersion medium in the particles is vaporized out of the particles, with the result that the inside of each particle forms a hollow; (2) foaming type microballoons obtained in the following manner: a low-boiling point liquid, such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling point liquid inside of the particles, whereby the inside of each particle is made to be hollow; and (3) microballoons obtained by foaming the above (2) under heating in advance, to make hollow polymer particles.

The particle size of the hollow polymer particles is preferably 0.1 to 20 μm, more preferably 0.1 to 2 μm, further preferably 0.1 to 1 μm, particularly preferably 0.2 to 0.8 μm. It is because an excessively small size may lead to decrease of the void ratio (hollow ratio) of the particles, prohibiting desirable heat-insulating property, while an excessively large size in relation to the film thickness of the heat insulation layer may result in problems in preparation of smooth surface and cause coating troubles due to the coarse or bulky particles.

The hollow ratio (percentage of hollowness) of the hollow polymer particles is preferably in the range of from about 20% to about 70%, and more preferably from 20% to 50%. If the hollow ratio is too small, it becomes difficult to obtain sufficient heat-insulating property. In contrast, if the hollow ratio is excessively high, a proportion (rate) of incomplete hollow particles increases in the aforementioned preferable range of the particle size, so that it becomes difficult to obtain sufficient film strength.

The "hollow ratio" of the hollow polymer particles as referred to here is a value P calculated according to the Formula (a), based on the transmission image photographed by a transmission micrograph of hollow particles.

$$P = \left\{ 1/n \times \sum_{i=1}^{n} (Rai/Rbi)^3 \right\} \times 100(\%) \quad \text{Formula (a)}$$

In formula (a), Rai represents the circle-equivalent diameter of the inner periphery (which shows the periphery of a hollow portion), among two peripheries constituting an image of a specific particle i; Rbi represents the circle-equivalent diameter of the outer periphery (which shows the outer shape of a particle in interest), among the two peripheries constituting the image of the specific particle i; and n is the number of measured particles, and n is generally 300 or more.

The glass transition temperature (Tg) of the hollow polymer particles is preferably 70° C. or higher, more preferably 100° C. or higher. These hollow polymer particles may be used in combination of two or more of those, according to need.

Such hollow polymer particles are commercially available. Specific examples of the above (1) include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). Specific examples of the above (2) include F-30, and F-50, manufactured by Matsumoto Yushi-Seiyaku Co., Ltd. (all of these product names are trade names). Specific examples of the above (3) include F-30E, manufactured by Matsumoto Yushi-Seiyaku Co., Ltd, and Expancel 461DE, 551DE, and 551DE20, manufactured by Nippon Ferrite (all of these product names are trade names). Among these, the hollow polymer particles of the above (1) may be preferably used.

In the heat insulation layer containing the hollow polymer particles, a water-dispersible-type resin or water-soluble-type resin is preferably added, as a binder (binder resin). As the binder resin that can be used in the present invention, use may be made of a known resin, such as an acrylic resin, a styrene/acrylic copolymer, a polystyrene resin, a polyvinyl alcohol resin, a vinyl acetate resin, an ethylene/vinyl acetate copolymer, a vinyl chloride/vinyl acetate copolymer, a styrene/butadiene copolymer, a polyvinylidene chloride resin, a cellulose derivative, casein, starch, and gelatin. In the present invention, gelatin is particularly preferably used. Further, these resins may be used either singly or as a mixture thereof.

The solid content of the hollow polymer particles in the heat insulation layer preferably falls in a range from 5 to 2,000 parts by mass, more preferably 5 to 1,000 parts by mass, and further preferably 5 to 400 parts by mass, assuming that the solid content of the binder resin be 100 parts by mass. Further, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, and thereby sufficient film strength cannot be obtained, causing deterioration in abrasion resistance.

The heat insulation layer of the heat-sensitive transfer image-receiving sheet that can be used in the present invention is preferably free of any resins that are not resistant to an organic solvent, except for the hollow polymer particles. Incorporation of the resin that is not resistant to an organic solvent (a resin having a dye-dyeing affinity) in the heat insulation layer is not preferable, in view of increase in blur of image after image transfer. It is assumed that a transferred dye that has dyed the receptor layer migrates through the heat insulation layer adjacent thereto with the lapse of time, owing to the presence of both the resin having a dye-dyeing affinity and the hollow polymer particles in the heat insulation layer.

Herein, the term "the resin that is not resistant to an organic solvent" means a resin having a solubility in an organic solvent (e.g., methyl ethyl ketone, ethyl acetate, benzene, toluene, xylene) of generally 0.5 mass % or more, preferably 1 mass % or more. For example, the above-mentioned latex polymer is included in the category of "the resin that is not resistant to an organic solvent".

A thickness of the heat insulation layer containing the hollow polymer particles is preferably from 5 to 50 μm, more preferably from 5 to 40 μm.

A void ratio (porosity ratio) of the heat insulation layer, which is calculated from the thickness of the heat insulation layer containing hollow polymer particles and the solid-matter coating amount of the heat insulation layer including the hollow polymer particles, is preferably 10 to 70% and more preferably 15 to 60%. When the void ratio of the heat-insulation layer is too low, sufficient heat insulation property cannot be obtained. When the void ratio is too large, the binding force among hollow polymer particles deteriorates, and thus sufficient film strength cannot be obtained, and abrasion resistance deteriorates.

The void ratio of the heat insulation layer as referred to herein is a value V calculated according to formula (b) below.

$$V = 1 - L/L \times \Sigma gi \cdot di \quad \text{Formula (b)}$$

In formula (b), L represents the thickness of the heat-insulating layer; gi represents the coating amount of a particular material i in terms of solid matter for the heat-insulating layer; and di represents the specific density of the particular material i. When di represents the specific density of the hollow polymer particles, di is the specific density of the wall material of hollow polymer particles.

<Undercoat Layer>

An undercoat layer may be formed between the receptor layer and the heat insulation layer. As the undercoat layer, for example, at least one of a white background controlling layer, a charge controlling layer, an adhesive layer, and a primer layer is formed. These layers may be formed in the same manner as those described in, for example, each specification of Japanese Patent Nos. 3585599 and 2925244.

(Curling Control Layer)

When the support is exposed as it is, there is the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

<Support>

In the present invention, a water-proof support is particularly preferably used as the support. The use of the waterproof support makes it possible to prevent the support from absorbing moisture, whereby a fluctuation in the performance of the receptor layer with lapse of time can be prevented. As the waterproof support, for example, coated paper or laminate paper may be used.

-Coated Paper-

The coated paper is a paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper and the like. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resins.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin.

(H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

-Laminated Paper-

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, both of the high-density polyethylene and the low-density polyethylene have a melt index of 1.0 to 40 g/10-min and a high extrudability.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

In order to prevent a heat-sensitive transfer image-receiving sheet from "getting caught" in a printer, it is preferable that the outermost surface of the sheet opposite to the receptive layer side has such a composition as described above.

The method of producing the heat-sensitive transfer image-receiving sheet for use in the present invention is explained below.

The heat-sensitive transfer image-receiving sheet for use in the present invention can be preferably formed, by applying at least one receptor layer, at least one intermediate layer and at least one heat-insulation layer, on a support, through simultaneous multi-layer coating.

It is known that in the case of producing an image-receiving sheet composed of plural layers having different functions from each other (for example, an air cell layer, a heat insulation layer, an intermediate layer and a receptor layer) on a support, it may be produced by applying each layer successively one by one, or by overlapping the layers each already coated on a support or substrate, as shown in, for example, JP-A-2004-106283, JP-A-2004-181888 and JP-A-2004-345267. It has been known in photographic industries, on the other hand, that productivity can be greatly improved, for example, by providing plural layers through simultaneous multi-layer coating. For example, there are known methods such as the so-called slide coating (slide coating method) and curtain coating (curtain coating method) as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-

43140, JP-A-63-80872, JP-A-54-54020, JP-A-5-104061, JP-A-5-127305, and JP-B-49-7050; and Edgar B. Gutoff, et al., "Coating and Drying Defects: Troubleshooting Operating Problems", John Wiley & Sons Company, 1995, pp. 101-103.

In the present invention, the productivity is greatly improved and, at the same time, image defects can be remarkably reduced, by using the above simultaneous multilayer coating for the production of an image-receiving sheet having a multilayer structure.

The plural layers in the present invention are structured using resins as its major components. Coating solutions forming each layer are preferably water-dispersible latexes. The solid content by mass of the resin put in a latex state in each layer coating solution is preferably in a range from 5 to 80% and particularly preferably 20 to 60%. The average particle size of the resin contained in the above water-dispersed latex is preferably 5 μm or less and particularly preferably 1 μm or less. The above water-dispersed latex may contain a known additive, such as a surfactant, a dispersant, and a binder resin, according to need.

In the present invention, it is preferred that a laminate composed of plural layers be formed on a support and solidified just after the forming, according to the method described in U.S. Pat. No. 2,761,791. For example, in the case of solidifying a multilayer structure by using a resin, it is preferable to raise the temperature immediately after the plural layers are formed on the support. Further, in the case where a binder (e.g., a gelatin) to be gelled at lower temperatures is contained, there is the case where it is preferable to lower the temperature immediately after the plural layers are formed on the support.

In the present invention, the coating amount of a coating solution per one layer constituting the multilayer is preferably in a range from 1 g/m$^2$ to 500 g/m$^2$. The number of layers in the multilayer structure may be arbitrarily selected from a number of 2 or more. The receptor layer is preferably disposed as a layer most apart from the support.

3) Heat-sensitive Transfer Sheet

The following is an explanation of a heat-sensitive transfer sheet (ink sheet) of the present invention.

The ink sheet is used together with the above-described heat-sensitive transfer image-receiving sheet at the time of a heat-sensitive transfer image formation. The ink sheet is composed of a support (base film) and, disposed thereon, heat-sensitive transfer layers (hereinafter sometimes referred to as dye layers) containing diffusion transfer dyes prepared in the form of dye ink.

The dye layers used in the present invention will be explained in detail below.

(Dye Layers)

The dye layers contain at least sublimation type dyes and a binder resin, It is a preferable embodiment that the dye layers also contain optional materials such as organic or inorganic finely divided powder, waxes, silicone resins, and fluorine-containing organic compounds according to need.

The dyes for use in the present invention is not particularly limited, so far as the dyes are able to diffuse by heat and able to be incorporated in a sublimation type heat-sensitive transfer sheet, and able to transfer by heat from the sublimation type heat-sensitive transfer sheet to an image-receiving sheet. As the dyes that are used for the heat-sensitive transfer sheet, ordinarily used dyes or known dyes can be effectively used.

Preferable examples of the dyes that is used in the present invention include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dye such as pyridone azo, thiophene azo, isothiazole azo, pyrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dyes include Disperse Yellow 231, Disperse Yellow 201 and Solvent Yellow 93. Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. As a matter of course, it is also possible to use suitable dyes other than these dyes as exemplified above.

Further, dyes each having a different hue from each other as described above may be arbitrarily combined together. For instance, a black hue can be obtained from a combination of dyes.

Dyes that can be preferably used in the present invention are explained in detail below.

In the heat-sensitive transfer layer (hereinafter, also referred to as "dye layer") of the ink sheet that is used in the present invention, use can be made of known dyes that have been used as a yellow dye from the past. Examples of the yellow dye include dyes represented by any one of formulae (Y1) to (Y4) set forth below. However, the yellow dyes that can be used in the present invention are not limited to these dyes.

First, the dye represented by formula (Y1) is explained in detail below.

Formula (Y1)

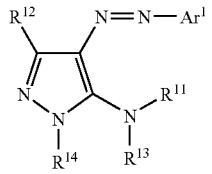

In formula (Y1), $R^{12}$ and $R^{14}$ each independently represent a monovalent substituent. $R^{11}$ and $R^{13}$ each independently represent a hydrogen atom or a monovalent substituent. There is no particular limitation on the substituent. Representative examples of the substituent include a halogen atom, an alkyl group, an alkenyl group, an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group (including an alkylamino group, an anilino group, and a heterocyclic amino group), an acylamino group, an aminocarbonylamino group, an alkoxycarbonylamino group, an aryloxycarbonylamino group, a sulfamoylamino group, an alkyl- or aryl-sulfonylamino group, an alkylthio group, a sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, and an imido group. Each of these groups may further be substituted.

In formula (Y1), $R^{13}$ and $R^{14}$ may represent atoms necessary to form a ring. There is no particular limitation to the atom groups necessary to form a ring. Typical examples are atoms represented by —C($R^{15}$)═N—, —N═C($R^{15}$)—, —C(═O)—C($R^{15}$)═C($R^{16}$)—, or —C(═O)—N($R^{15}$)—C(═O)—, wherein $R^{15}$ and $R^{16}$ each independently represent a hydrogen atom or a substituent. Examples of the substituent are the same as examples of the substituent represented by $R^{11}$, $R^{12}$, $R^{13}$ and $R^{14}$.

$R^{12}$ is preferably a hydrogen atom, an alkyl group, an alkoxy group, an aryl group, an alkoxycarbonyl group, a cyano group, or a carbamoyl group. $R^{14}$ is preferably a hydrogen atom, an alkyl group, an aryl group, or a heteroaryl group. $R^{11}$ and $R^{13}$ each are preferably a hydrogen atom or an alkyl group. Each of the above-mentioned groups may further be substituted.

In formula (Y1), $Ar^1$ represents an aryl group or a heterocyclic group. As $Ar^1$, an aryl group is preferred. The aryl group may be substituted with a substituent. Examples of the substituent include an alkyloxycarbonyl group, a sulfonyl group, a sulfonylamino group, a hydroxyl group, a nitro group in addition to the forgoing examples described as the substituent for $R^{11}$, $R^{12}$, $R^{13}$ and $R^{14}$.

Further, as $Ar^1$, a heterocyclic group is also preferred. As a preferable heterocyclic group, preferred is an aromatic heterocyclic group, more preferably a 5- or 6-membered aromatic heterocyclic group with specific examples including an imidazolyl group, a pyridyl group, a pyrazolyl group, a thiazolyl group, a benzoimidazolyl group, a quinolyl group, a benzopyrazolyl group, a benzothiazolyl group, an isothiazolyl group, a benzoisothiazolyl group, a pyridoisothiazolyl group and a thiadiazolyl group.

The maximum absorption wavelength of the azo dye represented by formula (Y1) that can be used in the present invention is preferably in the range of from 400 nm to 480 nm, more preferably from 420 nm to 460 nm.

Hereinafter, specific examples of the dye represented by formula (Y1) will be shown, but the present invention is not limited thereto.

Y1-1

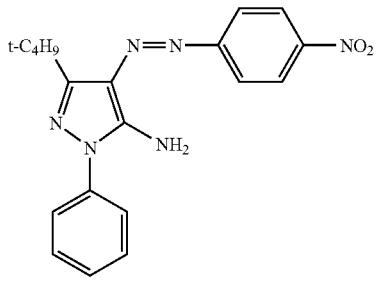

Y1-2

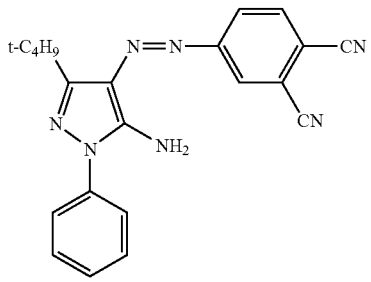

-continued

Y1-3

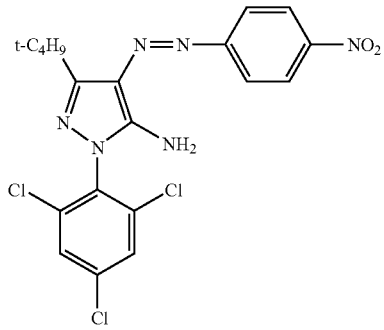

Y1-4

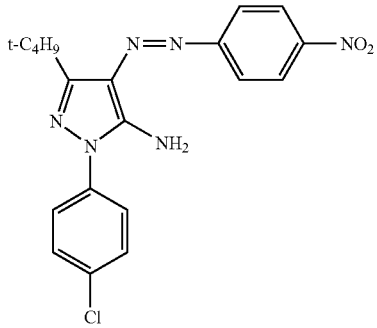

Y1-5

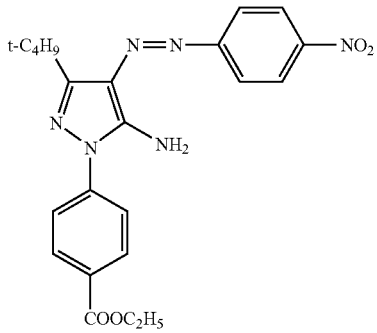

Y1-6

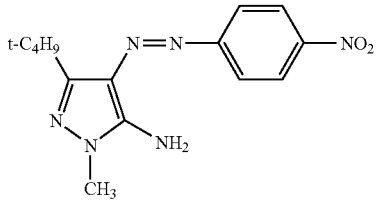

Y1-7

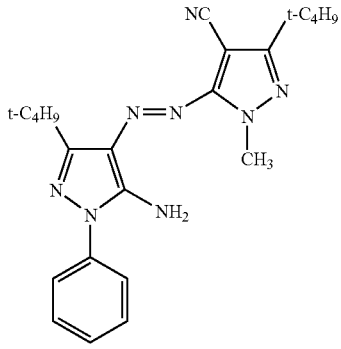

-continued

Y1-8

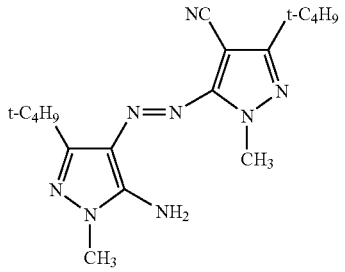

Y1-9

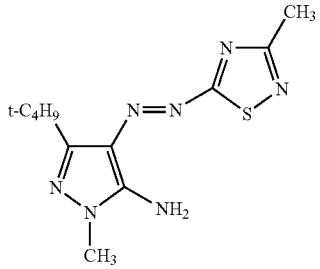

Y1-10

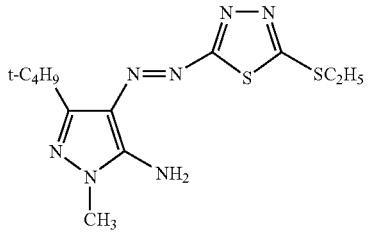

Next, the dye represented by formula (Y2) is explained in detail below.

Formula (Y2)

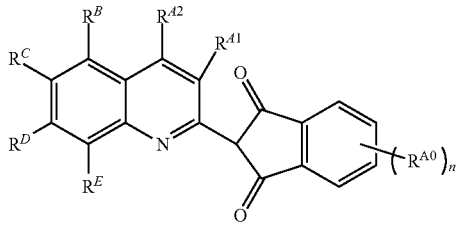

In formula (Y2), $R^{A0}$ represents a substituent, and n represents an integer of 0 to 4. $R^{A1}$, $R^{A2}$, $R^{B}$, $R^{C}$, $R^{D}$ and $R^{E}$ each independently represent a hydrogen atom, a halogen atom, a hydroxyl group, an alkyl group having 1 to 8 carbon atoms, a cycloalkyl group, an alkoxy group, an alkoxyalkoxy group, an alkoxycarbonyl group, an acyl group, a carbamoyl group, a sulfamoyl group, a thioalkoxy group, an alkylsulfonyl group, an amino group, a substituted or unsubstituted phenoxy group, or a substituted or unsubstituted thiophenoxy group. n is preferably 1 or 2, and $R^{A0}$ is preferably an acyl group, an alkoxycarbonyl group, a carbamoyl group or a sulfamoyl group, and more preferably an acyl group or an alkoxycarboyl group. $R^{A1}$ and $R^{A2}$ each independently are preferably a hydrogen atom or a hydroxyl group, and at least one of them is preferably a hydroxyl group.

Hereinafter, specific examples of the dye represented by formula (Y2) will be shown, but the present invention is not limited thereto.

Y2-1

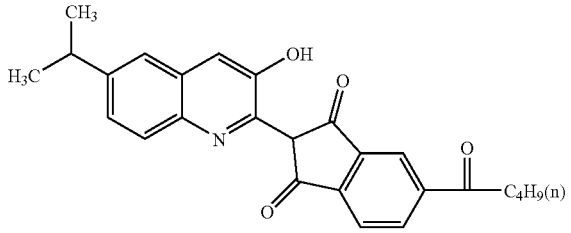

Y2-2

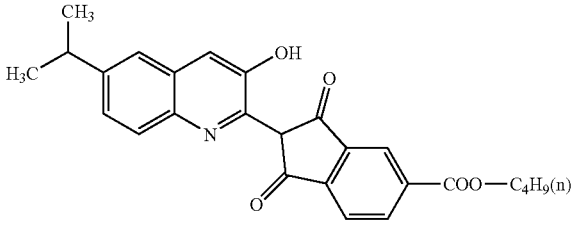

Y2-3

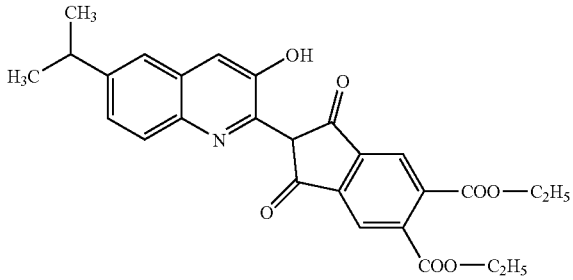

Next, the dye represented by formula (Y3) is explained in detail below.

Formula (Y3)

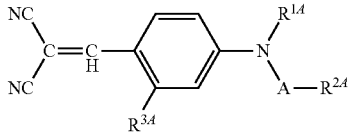

In formula (Y3), $R^{1A}$ represents an allyl group or an alkyl group; $R^{2A}$ represents a substituted or unsubstituted alkyl, aryl group, or acyl group; A represents a single bond or a divalent linkage group, and preferably a single bond, —$CH_2$—, —$CH_2CH_2$—, —$CH_2CH_2O$—, —$CH_2CH_2OCH_2$—, or —$CH_2CH_2OCH_2CH_2$—; and $R^{3A}$ represents a hydrogen atom or an alkyl group. Each group may further be substituted by a substituent; and examples of the substituent include a cycloalkyl group, an alkoxy group, an acyloxy group, and a hydroxyl group.

Hereinafter, specific examples of the dye represented by formula (Y3) will be shown, but the present invention is not limited thereto.

Y3-1

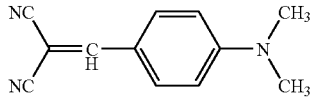

-continued

Y3-2

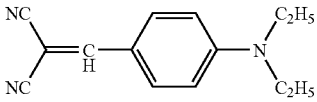

Y3-3

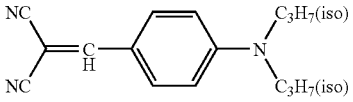

Y3-4

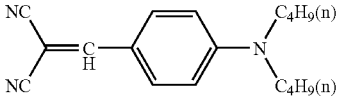

Y3-5

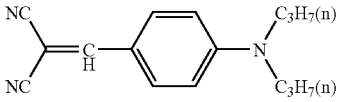

Y3-6

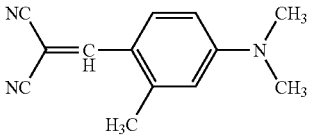

Y3-7

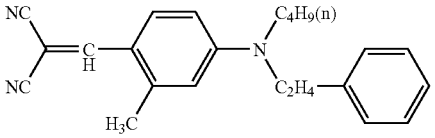

Y3-8

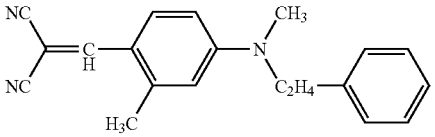

Y3-9

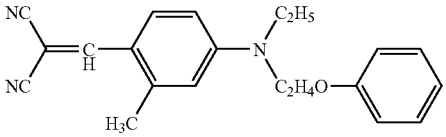

Y3-10

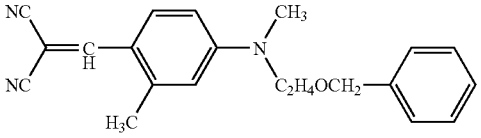

Y3-11

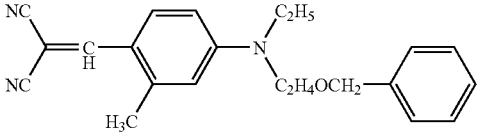

Y3-12

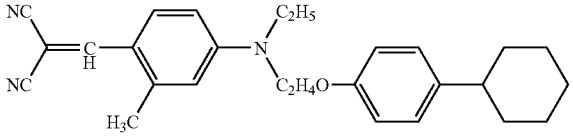

-continued

Y3-13

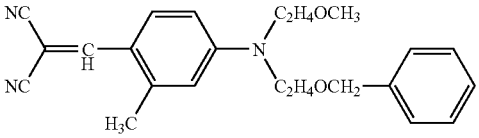

Y3-14

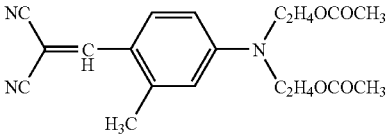

Next, the dye represented by formula (Y4) is explained in detail below.

Formula (Y4)

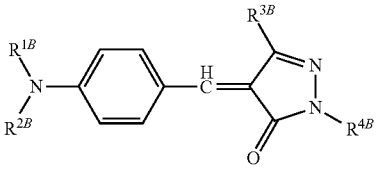

In formula (Y4), $R^{1B}$, $R^{2B}$, $R^{3B}$ and $R^{4B}$ each independently represent a hydrogen atom or a substituent. Examples of the substituent include an alkyl group, an aryl group, an alkoxy group, and alkylamino group.

Preferable examples of the (dye) compound represented by formula (Y4) are shown below, but the compounds that can be used in the present invention are not limited to the following specific examples.

Y4-1

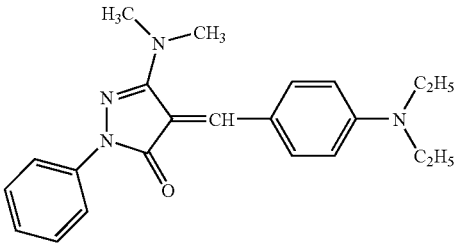

Y4-2

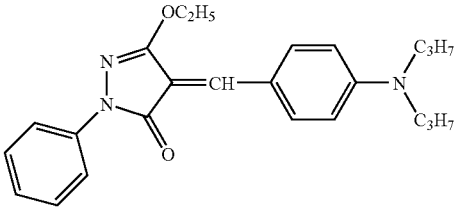

Y4-3

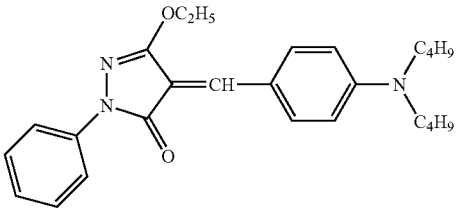

The dyes represented by formula (Y1), (Y2), (Y3) or (Y4) can be synthesized according to a known method.

Next, the magenta dye is explained in detail below.

In the heat-sensitive transfer layer of the ink sheet that is used in the present invention, use can be made of known dyes that have been used as a magenta dye from the past. Examples of the magenta dye include dyes represented by any one of formulae (M1) to (M4) set forth below. However, the magenta dyes that can be used in the present invention are not limited to these dyes.

First, the compound represented by formula (M1) is explained below.

Formula (M1)

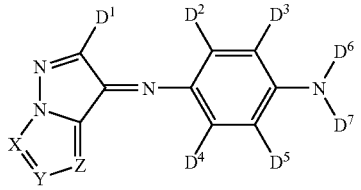

In formula (M1), $D^1$, $D^2$, $D^3$, $D^4$ and $D^5$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^6$ and $D^7$ each independently represent a hydrogen atom, an alkyl group, alkylcyano group or an aryl group; $D^6$ and $D^7$ may be bonded together to form a ring; $D^3$ and $D^6$ and/or $D^5$ and $D^7$ may be bonded together to form a ring; X, Y, and Z each independently represent $=C(D^8)$- or a nitrogen atom, in which $D^8$ represents a hydrogen atom, an alkyl group, an aryl group, an alkoxy group, an aryloxy group, or an amino group; when X and Y each represents $=C(D^8)$- or Y and Z each represents $=C(D^8)$-, two $D^8$s may be bonded together to form a saturated or unsaturated carbon ring; and each of the above-mentioned groups may further be substituted.

Among the compounds represented by formula (M1), compounds represented by formula (M1B) are preferable.

Formula (M1B)

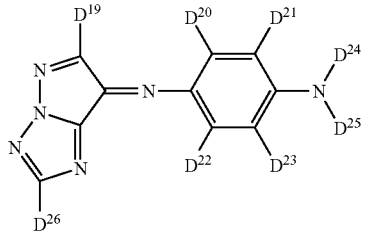

In formula (M1B), $D^{19}$, $D^{20}$, $D^{21}$ $D^{22}$ and $D^{23}$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group. Each of $D^{19}$ to $D^{23}$ is the same as each of $D^1$ to $D^5$ in the foregoing formula (M1), and the preferable range of each of $D^{19}$ to $D^{23}$ is the same as each of $D^1$ to $D^5$.

$D^{24}$ and $D^{25}$ each independently represent a hydrogen atom, an alkyl group, an alkylcyano group or an aryl group. $D^{24}$ and $D^{25}$ may be bonded together to form a ring. Each of $D^{24}$ and $D^{25}$ is the same as each of $D^6$ and $D^7$ in the foregoing formula (M1), and the preferable range of each of $D^{24}$ and $D^{25}$ is the same as $D^6$ and $D^7$.

$D^{26}$ represents a hydrogen atom, an alkyl group, an alkoxy group an aryloxy group or an amino group. $D^{26}$ is the same as $D^8$ in the foregoing formula (M1), and the preferable range is the same as $D^8$.

Each of the above-mentioned groups may further be substituted.

Hereinafter, specific examples of the dye represented by formula (M1) will be shown, but the present invention is not limited thereto.

M1-1

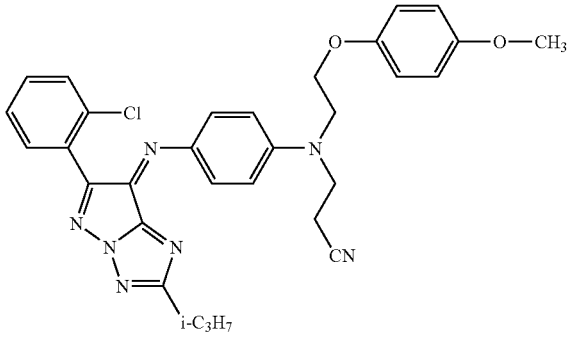

M1-2

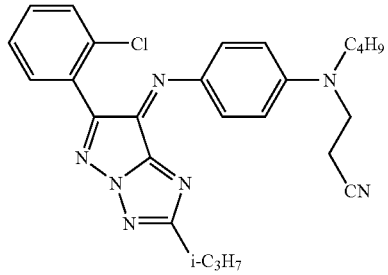

M1-3

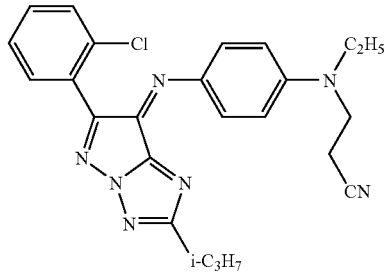

M1-4

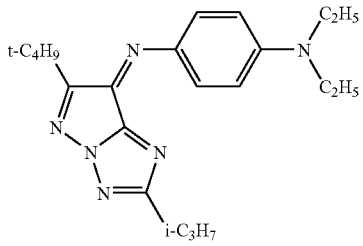

-continued

M1-5

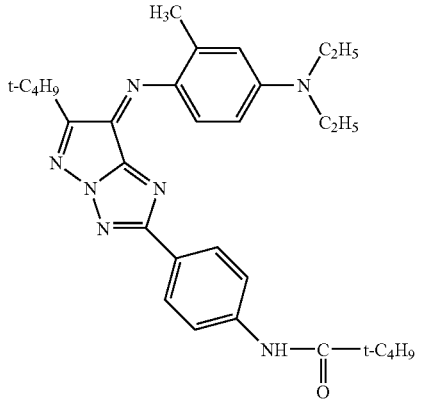

M1-6

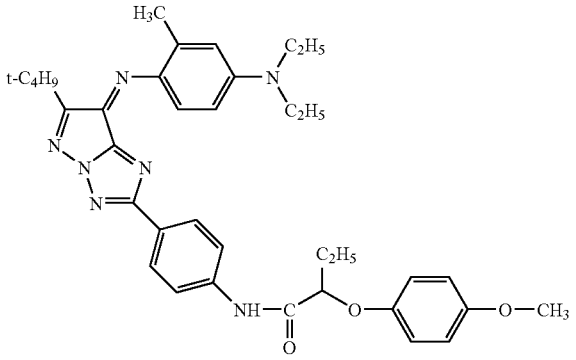

M1-7

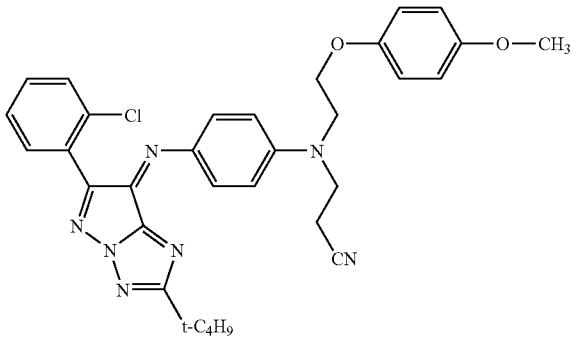

The compound represented by formula (M2) is explained in detail.

A-N=N-E Formula (M2)

In formula (M2), A represents an optionally substituted heterocyclic group whose hetero ring is selected from imidazole, pyrrazole, thiazole, benzothiazole, isothiazole, benzoisothiazole and thiophene. Preferred heterocyclic rings are an imidazoly group, a pyrazolyl group, a thiazolyl group, a benzothiazolyl group, an isothiazolyl group, a benzoisothiazolyl group or a thienyl group, each of which may further be substituted. Of these substituents, preferred is an imidazoly group.

Examples of the substituent with which the heterocyclic group represented by A may be substituted include a cyano group, a thiocyano group, a nitro group, a halogen atom, an alkyl group, an alkoxy group, a formyl group, an alkylthio group, an alkylsulfonyl group, an alkoxycarbonyl group, and an alkylcarbonyl group. Of these substituents, preferred are a cyano group, a thiocyano group, a cyanomethyl group, a nitro group, and alkyl group.

E represents an optionally substituted aminophenyl group, tetrahydroquinolinyl group, yulolidyl group, or aminoquinolinyl group. Herein, the amino moiety in the aminophenyl group and the aminoquinolinyl group embraces an amino group and a substituted amino group. Examples of the substituent with which E may be substituted include an alkyl group, an alkenyl group, a cycloalkyl group, an aryl group, an amide group, and a heterocyclic group.

E is preferably an aminophenyl group substituted with an alkyl group or an amide group.

Hereinafter, specific examples of the dye represented by formula (M2) will be shown, but the present invention is not limited thereto.

M2-1

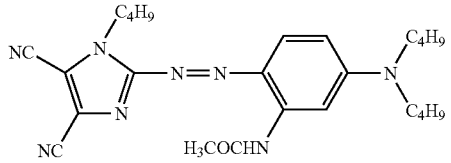

M2-2

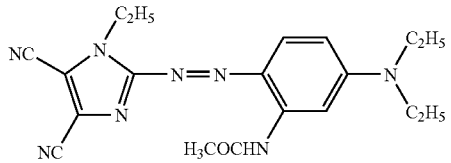

M2-3

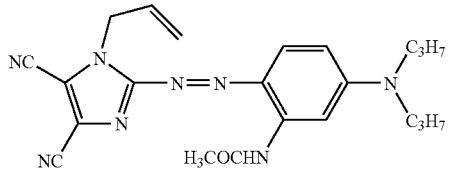

M2-4

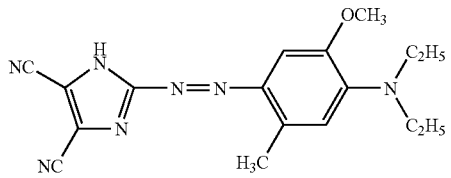

M2-5

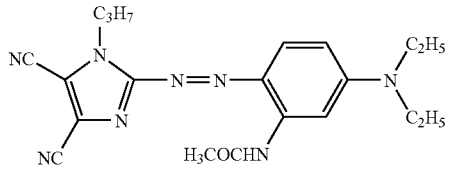

M2-6

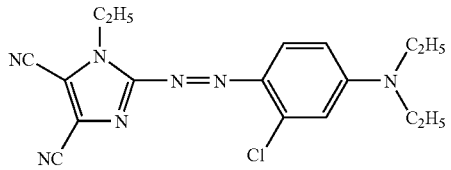

M2-7

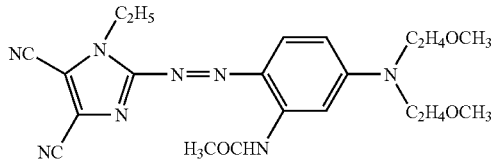

Next, the compound represented by formula (M3) or (M4) is explained in detail.

Formula (M3)

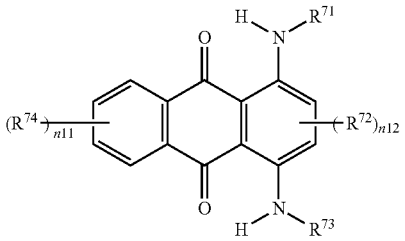

Formula (M4)

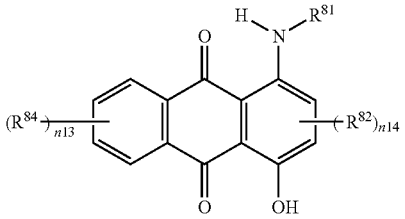

In formula (M3), $R^{71}$ and $R^{73}$ each independently represent a hydrogen atom or a substituent; $R^{72}$ and $R^{74}$ each independently represent a substituent; n11 represents an integer of 0 to 4; n12 represents an integer of 0 to 2; when n11 represents an integer of 2 to 4, $R^{74}$s may be the same or different from each other; and when n12 represents 2, $R^{72}$s may be the same or different from each other. Examples of the substituents represented by $R^{71}$ to $R^{74}$ include a halogen atom, an alkyl group (including a cycloalkyl group regardless of ring number), an alkenyl group (including a cycloalkenyl group regardless of ring number), an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group (including an alkylamino group and an anilino group), an acylamino group, an aminocarbonylamino group, an alkoxycarbonylamino group, an aryloxycarbonylamino group, a sulfamoylamino group, an alkyl- or aryl-sulfonylamino group, an alkylthio group, an sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, and an imido group. Each of the above-mentioned substituents may further be substituted.

Examples of $R^{71}$ and $R^{73}$ include a hydrogen atom, a substituted or unsubstituted alkyl group, a substituted or unsubstituted alkenyl group, a substituted or unsubstituted aryl group, or a substituted or unsubstituted heterocyclic group, and preferably a hydrogen atom or a substituted or unsubstituted alkyl group, more preferably a hydrogen atom or a substituted or unsubstituted alkyl group having 1 to 6 carbon atoms, and still furthermore preferably a hydrogen atom.

Examples of $R^{72}$ and $R^{74}$ each include a halogen atom, an alkyl group, an alkenyl group, an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl- or aryl-sulfonylamino group, an alkylthio group, an sulfamoyl group, an alkyl- or aryl-sulfinyl group, an alkyl- or aryl-sulfonyl group, an acyl group, an aryloxycarbonyl group, an alkoxycarbonyl group or a carbamoyl group. Each of $R^{72}$ and $R^{74}$ is preferably an alkoxy group, an aryloxy group, an acyloxy group, a carbamoyloxy group, an alkoxycarbonyloxy group, or an aryloxycarbonyloxy group, and more preferably an alkoxy group or an aryloxy group. Each of the above-mentioned substituents may further be substituted.

In formula (M4), $R^{81}$ represents a hydrogen atom or a substituent, $R^{82}$ and $R^{84}$ each independently represent a substituent, n13 represents an integer of 0 to 4, and n14 represents an integer of 0 to 2. When n13 represents an integer of 2 to 4, $R^{84}$s may be the same or different from each other. When n14 represents 2, $R^{82}$s may be the same or different from each other. Examples of the substituents each represented by $R^{81}$, $R^{82}$ and $R^{84}$ include those given as examples of the substituent each represented by $R^{71}$ to $R^{74}$ set forth above.

Examples of the substituent represented by $R^{81}$ include those given as examples of the substituents as described about $R^{71}$ and $R^{73}$, and preferable examples thereof are also same. $R^{81}$ is more preferably a hydrogen atom or a substituted or unsubstituted alkyl group having 1 to 6 carbon atoms, and further preferably a hydrogen atom.

Examples of the substituent represented by $R^{82}$ and $R^{84}$ include those given as examples of the substituent as described about $R^{72}$ and $R^{74}$. $R^{82}$ and $R^{84}$ each independently are more preferably an alkoxy group, an aryloxy group, an acyloxy group, a carbamoyloxy group, an alkoxycarbonyloxy group and an aryloxycarbonyloxy group; and further preferably an alkoxy group and an aryloxy group. Each of these groups may be further substituted.

The following is an explanation about a preferable combination of various substituents (atoms) that a dye represented by formula (M3) or (M4) may have: A preferred compound is a compound in which at least one of the substituents is the above-described preferable substituent. A more preferred compound is a compound in which more substituents are the above-described preferable substituents. The most preferred compound is a compound in which all substituents are the above-described preferable substituents.

In the compound represented by formula (M3), it is preferable that $R^{71}$ is a hydrogen atom, $R^{72}$ is an aryloxy group, $R^{73}$ is a hydrogen atom, n11 is an integer of 0, and n12 is an integer of 0 to 2. It is more preferable that $R^{71}$ is a hydrogen atom, $R^{72}$ is an aryloxy group, $R^{73}$ is a hydrogen atom, n11 is integer of 0, and n12 is an integer of 2.

In the compound represented by formula (M4), it is preferable that $R^{81}$ is a hydrogen atom, $R^{82}$ is an aryloxy group, n13 is an integer of 1 to 2, and n14 is an integer of 0. It is more preferable that $R^{81}$ is a hydrogen atom, $R^{82}$ is an aryloxy group, n13 is an integer of 1, and n14 is an integer of 0. It is further preferable that $R^{81}$ is a hydrogen atom, $R^{82}$ is an aryloxy group, n13 is an integer of 1, n14 is an integer of 0, and said $R^{82}$ is positioned at ortho-site to the amino group.

Hereinafter, specific examples of the dyes represented by formula (M3) and (M4) will be shown, but the present invention is not limited thereto.

M3-1

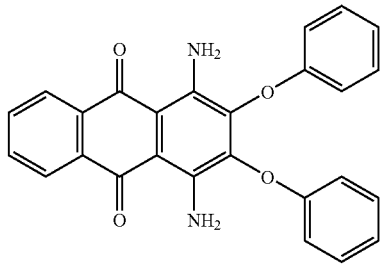

-continued

M3-2

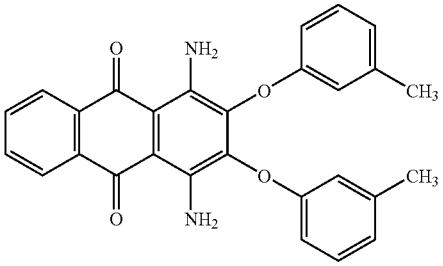

M4-1

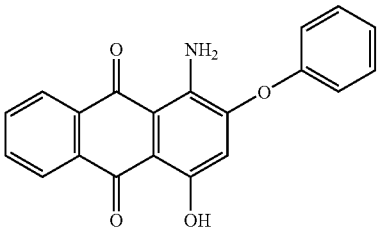

M4-2

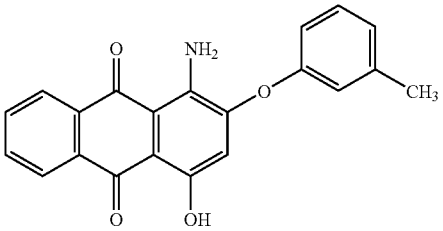

The compounds represented by any of formula (M1) to (M4) can be synthesized according to a known method.

Next, the cyan dye is explained in detail below.

In the heat-sensitive transfer layer of the ink sheet that is used in the present invention, use can be made of known dyes that have been used as a cyan dye from the past. Examples of the cyan dye include dyes represented by formula (C1) or (C2) set forth below. However, the cyan dyes that can be used in the present invention are not limited to these dyes.

First, the dye represented by formula (C1) is explained in detail.

Formula (C1)

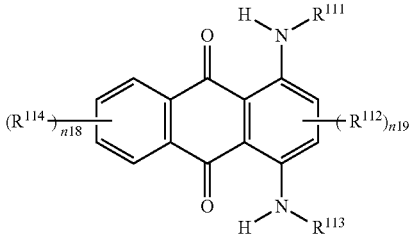

In formula (C1), $R^{111}$ and $R^{113}$ each independently represent a hydrogen atom or a substituent; $R^{112}$ and $R^{114}$ each independently represent a substituent; n18 represents an integer of 0 to 4; n19 represents an integer of 0 to 2; when n18 represents an integer of 2 to 4, $R^{114}$s may be the same or different from each other; and when n19 represents 2, $R^{112}$s may be the same or different from each other. Examples of the substituents represented by $R^{111}$ to $R^{114}$ include a halogen atom, an alkyl group, an alkenyl group, an alkynyl group, an aryl group, a heterocyclic group, an alkoxy group, an aryloxy group, a formyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl- or aryl-sulfonylamino group, an alkylthio group, an sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, and an imido group.

Examples of the substituents represented by $R^{111}$ and $R^{113}$ include a hydrogen atom, a substituted or unsubstituted alkyl group, a substituted or unsubstituted alkenyl group, a substituted or unsubstituted aryl group, and a substituted or unsubstituted heterocyclic group. $R^{111}$ and $R^{113}$ each are more preferably a hydrogen atom, a substituted or unsubstituted alkyl group having 1 to 6 carbon atoms, or a substituted or unsubstituted aryl group.

Examples of the substituents represented by $R^{112}$ and $R^{114}$ include a halogen atom, an alkyl group, an alkenyl group, an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl- or aryl-sulfonylamino group, an alkylthio group, an sulfamoyl group, an alkyl- or aryl-sulfinyl group, an alkyl- or aryl-sulfonyl group, an acyl group, an aryloxycarbonyl group, an alkoxycarbonyl group, and a carbamoyl group. $R^{112}$ and $R^{114}$ each independently are more preferably a halogen atom, an alkyl group, an alkenyl group, an aryl group, a heterocyclic group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, an alkylthio group, an acyl group, an aryloxycarbonyl group, an alkoxycarbonyl group, or carbamoyl group, further preferably a halogen atom, a substituted or unsubstituted alkyl group. $R^{112}$ and $R^{114}$ each are more preferably a substituted or unsubstituted alkenyl group, a substituted or unsubstituted aryl group, or a substituted or unsubstituted heterocyclic group, and still more preferably a substituted or unsubstituted alkyl group.

Hereinafter, specific examples of the dye represented by formula (C1) will be shown, but the present invention is not limited thereto.

C1-1

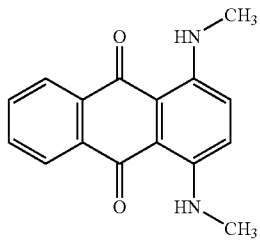

-continued

C1-2

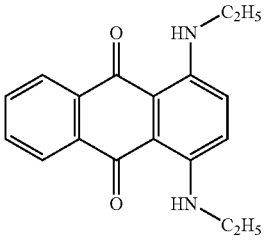

C1-3

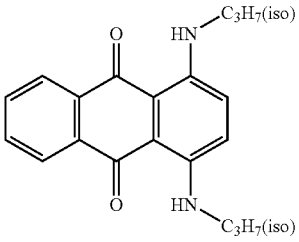

C1-4

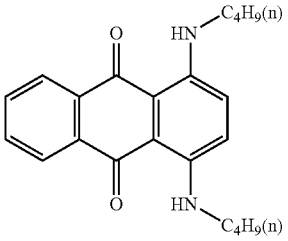

C1-5

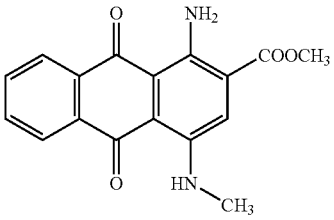

C1-6

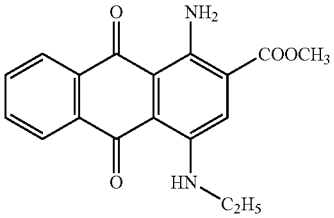

C1-7

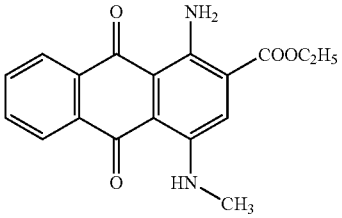

C1-8

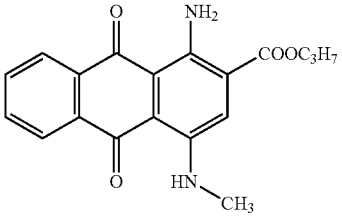

-continued

C1-9

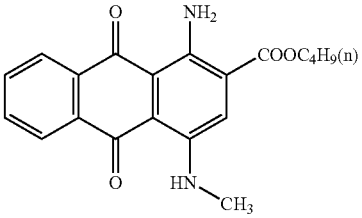

C1-10

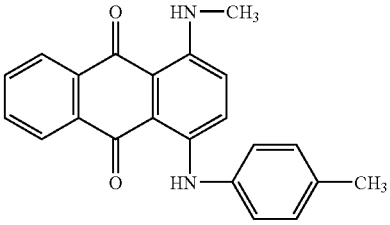

C1-11

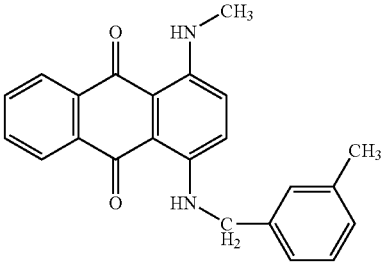

C1-12

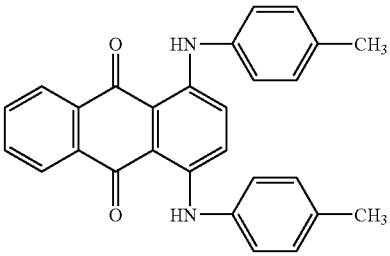

Among the dyes represented by the above-described formula (C1), those not available on the market can be synthesized according to the methods described in publications or specifications of U.S. Pat. Nos. 4,757,046 and 3,770,370, German Patent No. 2316755, JP-A-2004-51873, JP-A-7-137455, and JP-A-61-31292, and J. Chem. Soc. Perkin. Transfer I, 2047 (1977), *Merocyanine Dye—Doner Element Used in thermal Dye Transfer*, authored by Champan.

Next, the dye represented by formula (C2) is explained in detail.

Formula (C2)

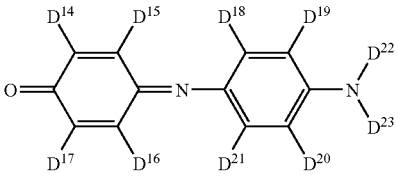

In formula (C2), $D^{14}$ to $D^{21}$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group or an amino group. $D^{22}$ and $D^{23}$ each independently represent a hydrogen atom, an alkyl group or an aryl group. $D^{22}$ and $D^{23}$ may be bonded together to form a ring. $D^{19}$ and $D^{22}$ and/or $D^{20}$ and $D^{23}$ may be bonded together to form a ring.

$D^{14}$ is preferably an acylamino group, a ureido group or an alkoxycarbonyl group; more preferably an acylamino group or a ureido group; furthermore preferably an acylamino group; and most preferably a group represented by the following formula (IV).

$$—NH—C(=O)-D^{24} \qquad \text{Formula (Iv)}$$

In formula (IV), $D^{24}$ is an alkyl group (preferably an alkyl group having 1 to 12 carbon atoms, e.g., methyl, ethyl, isopropyl, n-propyl, t-butyl), an aryl group (preferably an aryl group having 6 to 10 carbon atoms, e.g., phenyl, m-nitrophenyl, p-nitrophenyl, p-tolyl, p-methoxyphenyl, naphthyl, m-chlorophenyl, p-chlorophenyl) or a heterocyclic group (preferably a 5- to 8-membered heterocyclic group having 0 to 10 carbon atoms and containing, as a ring-constituting atom(s), a hetero atom selected from an oxygen atom, a nitrogen atom and a sulfur atom, e.g., pyridyl, furyl, tetrahydrofuryl). $D^{24}$ is preferably a heterocyclic group or an alkyl group, and more preferably a pyridyl group, a furyl group, or a tetrahydrofuryl group.

$D^{15}$, $D^{16}$, $D^{18}$, $D^{19}$, $D^{20}$ and $D^{21}$ each are preferably a hydrogen atom or an alkyl group (preferably an alkyl group having 1 to 12 carbon atoms, e.g., methyl, ethyl, isopropyl, n-propyl, t-butyl), and more preferably a hydrogen atom, a methyl group or an ethyl group. $D^{17}$ is preferably a hydrogen atom, an alkyl group (preferably an alkyl group having 1 to 12 carbon atoms, e.g., methyl, ethyl, isopropyl, n-propyl, t-butyl), a halogen atom, a cyano group, a nitro group, or a heterocyclic group; and more preferably a hydrogen atom or a halogen atom. $D^{16}$ and $D^{17}$ may bond together, to form a ring. $D^{22}$ and $D^{23}$ each are preferably a hydrogen atom or an alkyl group (preferably an alkyl group having 1 to 12 carbon atoms, e.g., methyl, ethyl, isopropyl, n-propyl, t-butyl), and more preferably a methyl group, an ethyl group or an n-propyl group. These alkyl groups may be substituted with another substituent. In the case that the alkyl group is substituted with another substituent, preferable examples of the "another" substituent include a heterocyclic group, a halogen atom, an alkoxy group, an aryloxy group, an amino group, an acyl group, a acyloxy group, an acylamino group, an alkylthio group, an arylthio group, a sulfonylamino group, a sulfonyl group, a sulfinyl group, a carbamoyl group, a sulfamoyl group, an alkoxycarbonyl group and an aryloxycarbonyl group, with more preferable example being a carbamoyl group. $D^{22}$ and $D^{23}$ each are further preferably a hydrogen atom, a methyl group or an ethyl group.

Hereinafter, specific examples of the dye represented by formula (C2) will be shown, but the present invention is not limited thereto.

C2-1

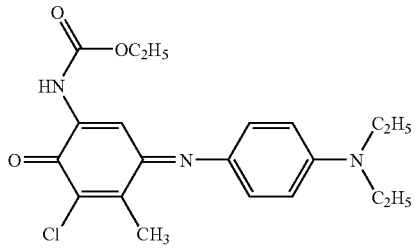

C2-2

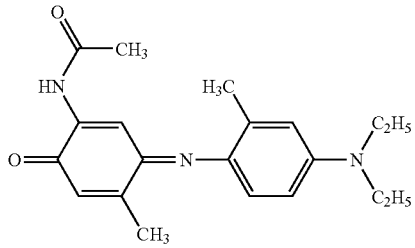

C2-3

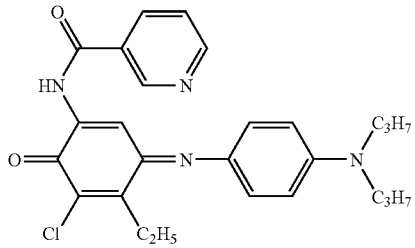

C2-4

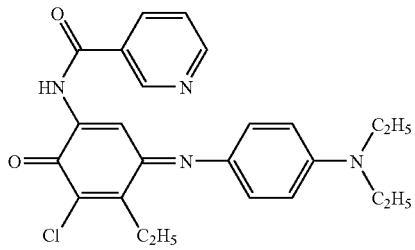

C2-5

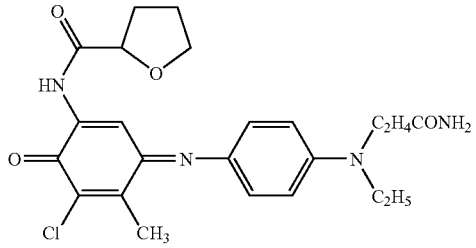

C2-6

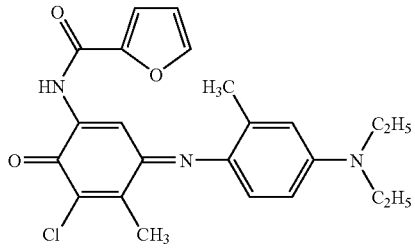

-continued

C2-7

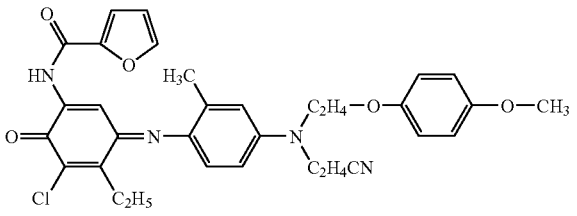

The dye represented by formula (C2) can be synthesized according to a known method.

(Binder Resin)

As the binder resin that is contained in the dye inks in order to keep the aforementioned dye, various kinds of binder resin are known, and these can be used in the present invention. Examples of these binder resins include modified cellulose resins such as ethyl cellulose, hydroxyethyl cellulose, ethyl hydroxycellulose, hydroxypropyl cellulose, ethylhydroxyethyl cellulose, methyl cellulose, cellulose acetate, cellulose acetate butyrate, cellulose acetate propionate, and cellulose nitrate; vinyl resins such as polyvinyl alcohol, polyvinyl acetate, polyvinyl butyrate, polyvinyl acetal, polyvinyl pyrroridone, polystyrene, and polyvinyl chloride; acrylic resins such as polyacrylonitrile, polyacrylate, and polyacrylamide; polyurethane resins, polyamide resins, polyester resins, polycarbonate resins, phenoxy resins, phenol resins, epoxy resins, and various kinds of elastomers. Each of these resins set forth above are preferably used. These resins may be used alone, or mixed together. In the case of polymers, various kinds of resin-constituting monomers may be copolymerized before use. It is also a preferable embodiment to crosslink the polymers with various kinds of cross-linking agents.

Among these binder resins, a modified cellulosic resin or a vinyl resin is preferably used, a propionic acid-modified cellulose, a polyvinylbutyral and a polyvinyl acetacetal are more preferably used.

(Solvent)

The dye ink can be prepared by dissolving or dispersing the above-described sublimation type dye and binder resin. As a solvent that is used at the time of preparation, various kinds of known solvents can be used. Examples of the solvent include alcohol-series solvents such as methanol, ethanol, isopropyl alcohol, butanol, and isobutanol; ketone-series solvents such as methyl ethyl ketone, methyl isobutyl ketone, and cyclohexanone; aromatic solvents such as toluene and xylene; and water. The solvents may be used singly, or as a mixture thereof.

(Additives)

In addition to the dye and the binder, various kinds of additives can be added to the dye layers in order to improve various performances such as storage stability, transporting properties in a printer and releasing properties after printing. As typical additives, organic or inorganic fine-particles and waxes are preferably used.

As the organic particles, it is preferred to use fine particles of a resin exemplified by polyolefin resins such as polyethylene and polypropylene, fluorine resins, polyamide resins such as nylon resins, urethane resins, styrene-acryl series crosslinked resins, phenol resins, urea resins, melamine resins, polyimide resins, and benzoguanamine resins. Polyethylene fine-particles are more preferably used. As the inorganic particles, it is preferred to use fine particles of, for example, calcium carbonate, silica, clay, talc, titanium oxide, magnesium hydroxide, or zinc oxide.

The organic or inorganic fine-particles are preferably contained in a range of from 0.5 to 5 mass %, based on the binder resin of the dye layer ink.

It is also a preferable embodiment that a wax is contained in the dye layer ink, in addition to the above-described sublimation-type dye, binder resin, and organic or inorganic fine-particles. As the wax that can be used, preferred are waxes derived from petroleum such as microcryastalline wax and paraffin wax; waxes derived from mineral such as montan wax; waxes derived from plants such as carnauba wax, Japan wax and candelilla wax; waxes derived from animals such as bees wax, spermaceti, insect wax and shellac wax; synthetic waxes such as various kinds of low molecular polyethylene, aliphatic acid esters, aliphatic acid amides and silicone wax and partially modified waxes.

Further, another preferable embodiment is to contain resins such as silicone resin, fluorine resin, acrylic resin, cellulose resin, vinyl chloride/vinyl acetate copolymer, and pyroxylin in the dye layer ink. These waxes and resins may be contained in the dye layer ink in the range of preferably from 0.1 mass % to 10 mass %, more preferably from 1 mass % to 3 mass %, based on the total solid content of the dye layer.

Next, explained is a composition of the heat-sensitive sheet used in the method of image formation in the present invention.

The heat-sensitive transfer sheet according used in the image-forming method of the present invention has at least one color-providing dye layer disposed on one surface of the support, wherein the dye layer is formed by coating the above-described dye layer ink.

<Support>

As the support, any one of known materials can be used, so far as such the material has both a sufficient heat resistance and a sufficient mechanical strength. Specific examples of preferable supports include thin papers such as a glassine paper, a condenser paper, and a paraffin paper; polyesters having high resistance to heat such as polyethyleneterephthalate, polyethylenenaphthalate, polybuyleneterephthalate, polyphenylene sulfide, polyetherketone, and polyethersulfone; stretched or unstreched films of plastics such as polypropylene, polycarbonate, cellulose acetate, polyethylene derivatives, poly(vinyl chloride), poly(vinylidene chloride), polystyrene, polyamide, polyimide, polymethylpentene, and ionomers; and laminates of these materials. Of these materials, polyester films are especially preferred. Stretched polyester films are most preferred. A thickness of the support can be properly determined in accordance with the material of the support so that the mechanical strength and the heat resistance become optimum. Specifically, it is preferred to use a support having a thickness of about 1 μm to about 100 μm, more preferably from about 2 μm to 50 μm, and further preferably from about 3 μm to about 10 μm.

It is essential in the sublimation type heat-sensitive transfer recording system that only a dye with a single hue that is contained in a heat-sensitive transfer sheet must be transferred at the time of printing. Transfer of a resin carrying the dye is not preferred. Therefore, adhesion between the dye layer and the support of the heat-sensitive transfer sheet must be strong. If the adhesion is weak, the dye layer in itself adheres to the heat-sensitive image-receiving sheet, thereby resulting in deterioration of print image quality.

In the case of the support such as a polyester film exemplified above as a preferable support, wettability of the ink with each hue as described later is not so good that adhesive strength occasionally lacks.

In order to deal with such the problem, it is preferred to employ a method of physically treating a surface of the support, and/or a method of forming an easy adhesion layer.

It is preferred to form an easy adhesion layer composed of a resin on a support and to dispose a dye layer on the easy adhesion layer. As a resin for forming the easy adhesion layer, there can be used, for example, urethane resins, polyester resins, polypropylene resins, polyol resins, acrylic resins, and reaction products of these resins and isocyanate compounds. Examples of the isocyanate compound include diisocyanate compounds and triisocyanate compounds, each of which is used from the past. A coating amount is preferably from 0.05 $g/m^2$ to 0.1 $g/m^2$.

In the production of the heat-sensitive transfer sheet, a support on which an easy adhesion layer is disposed in advance can be used, and a dye layer can be formed on the said support.

(Coating Method for Dye Layer)

The dye layer that is used in the heat sensitive transfer sheet of the present invention is formed by coating a dye layer ink on a support using a gravure printing method or other forming means, followed by drying. The dye layer ink is obtained by dissolving or dispersing, in a proper solvent, sublimation type dyes, a binder resin and optionally used additives such as organic or inorganic finely divided powder and waxes.

A dry thickness of the dye layer is preferably in the range of from about 0.2 $g/m^2$ to about 5 $g/m^2$, more preferably from about 0.4 $g/m^2$ to about 2 $g/m^2$. Content of the sublimation type dye is preferably in the range of from 5 mass % to 90 mass %, more preferably from about 10 mass % to about 70 mass %, based on the dye layer.

FIGS. 2(*a*), 2(*b*), 2(*c*), and 3 show some preferable embodiments of the heat-sensitive transfer sheet (i.e. ink sheet) for use in the present invention. FIGS. 2 (*a*) to 2(*c*) are plan views of the heat-sensitive transfer sheet in which dye layers with each hue have been formed in area sequence (area order or formed in a plane sequential manner). FIG. 3 is a sectional view showing one of preferable embodiments of the heat-sensitive transfer sheet for use in the present invention.

In the heat-sensitive transfer ink sheet for use in the present invention, it is preferable that at least two dye layers are disposed so that these layers are not superimposed with one another. Generally in the thermal transfer sheet, yellow, magenta and cyan are printed in this order. Accordingly, it is preferred to dispose a yellow dye layer Y, a magenta dye layer M, and a cyan dye layer C on the same support in this order and in area sequence of the dye layer with each hue, as shown in FIG. 2(*a*). Further, a black layer BK may be disposed as shown in FIG. 2(*b*). Further, as shown in FIG. 2(*c*), it is also preferred to provide a transferable protective layer laminate 4, which will be described in the below, in a proper position among the ink layer 3 constructed of Y, M, C, and BK. However, the disposal of the dye layer with each hue is not limited to these embodiments, but any arrangement may be used at need.

The term "forming layers in area order" as used herein means forming dye layers each having a different hue and/or function layers in the longitudinal direction on the support of the heat-sensitive transfer sheet, by applying them separately in order.

Examples include the case in which a yellow dye layer, a magenta dye layer, and a cyan dye layer are formed in this order in the longitudinal direction on the support.

Further, any arrangement of these dye layers can be employed, but it is preferred that a yellow dye layer, a magenta dye layer, and a cyan dye layer be arranged sequentially in this order on the support.

Arrangement of the dye layers of different hues in the present invention is not limited to the above, and a black or other dye layer of a hue other than yellow, magenta, and cyan can be employed as required. Further, it is preferred to form a transferable protective layer (a transferable protective layer laminate) as a function layer, after forming the yellow dye layer, the magenta dye layer, and the cyan dye layer in this order in the longitudinal direction on the support, as mentioned above.

Further, releasing properties between the transfer sheet and the image-receiving sheet are changed depending on the printing order. Therefore, it is also a preferable embodiment to change content of additives for use in each of the dye layers in response to the change of releasing properties. For example, as a dye layer is used later for printing, it is possible to increase content of the releasing agent in the dye layer.

In the heat-sensitive transfer sheet according to the present invention, the dye layer in each color and the transferring protective layer described below may have a single-layer structure or a multi-layer structure of two, three or more layers. In addition, the dye layer in each color may have a single-layered structure and also a multi-layer structure at the same time. In the present invention, at least three kinds of heat-sensitive transfer layers different in kind may be formed on one face of a base film as they are separated and unsuperimposed, but the dye layer in each color may have a multi-layer structure. It is possible, for example, to form multiple layers on a base film by preparing two yellow inks and applying the inks thereon, but not possible to form multiple layers, for example, by coating a yellow ink and a magenta ink on the same position of a base film sequentially. The composition as shown in FIG. 3 is an example of the above-described embodiment. Namely, the yellow dye layer Y, the magenta dye layer M, and the cyan dye layer C each has a single layer structure, while a multilayer structure is constructed by a laminate of a release layer 4*a*, a protective layer 4*b* and an adhesive layer 4*c* each of which constitutes a transferable protective layer laminate 4.

A total thickness of the dye layers having a multilayer structure is preferably in the range of from about 0.2 $g/m^2$ to about 5 $g/m^2$, more preferably from about 0.4 $g/m^2$ to about 2 $g/m^2$.

A thickness of one constituting layer of the dye layer is preferably in the range of from about 0.2 $g/m^2$ to about 2 $g/m^2$. A total content of the sublimation type dye is preferably in the range of from 5 mass % to 90 mass %, more preferably from about 10 mass % to about 70 mass %, based on the total dye layers.

<Transferable Protective Layer Laminate>

It is a preferable embodiment in the present invention to dispose a transferable protective layer laminate in the heat-sensitive transfer sheet. The transferable protective layer laminate is used to protect a heat-transferred image with a protective layer composed of a transparent resin, thereby to improve durability such as scratch resistance, light-fastness, and resistance to weather. Said protective layer is formed on the heat-transferred image by heat-sensitive transfer. Under the conditions that a dye transferred to the image-receiving sheet is left to be exposed at the front of the image-receiving sheet, some of the transferred dyes are unsatisfactory in image durability such as light-fastness, scratch resistance, and chemical resistance. Therefore, it is preferred to dispose the above-described transparent protective layer.

As one of preferable embodiments of the heat-sensitive transfer sheet (i.e. ink sheet) 1 according to the present invention, as exemplified in FIG. 3, a back side layer (a backing layer or a back-side insulation layer) 5 may be formed on one surface of the base film (i.e. support) 2, and a transferable protective layer laminate 4 which is constructed of a releasing layer 4*a*, a protective layer 4*b*, and an adhesive layer 4*c* may be formed on another side of the base film 2 in this order from the base film side. The protective layer 4*b* may be formed by plural layers. In the case where the protective layer 4*b* also has a function(s) of another layer(s), the releasing layer 4*a* or/and the adhesive layer 4*c* can be omitted. It is also possible to use a base film 2 on which an easy adhesive layer has already been formed. In the figure, the reference numeral 3 indicates a dye layer (an ink layer or a heat-sensitive transfer layer).

As a protective layer-forming resin, preferred are resins that are excellent in scratch resistance, chemical resistance, transparency and hardness. Examples of the resin include polyester resins, polystyrene resins, acrylic resins, polyurethane resins, acrylic urethane resins, silicone-modified resins of the above-described resins, mixtures of these resins, ionizing radiation-curable resins, and ultraviolet-shielding resins. In addition, there can be used various kinds of resins that are known from the past as a protective layer-forming resin. Further, in order to give ultraviolet absorbing capacity, or to improve coat separation properties at the time of transfer, gloss, brightness, or the like, it is also preferred to add ultraviolet absorbing agents, antioxidants, fluorescent brightening agents, organic fillers and/or inorganic fillers in accordance with necessity.

As the acrylic resin that can be used in the present invention, use can be made of polymers derived from at least one monomer selected from conventionally known acrylate monomers and methacrylate monomers. Other monomers than these acrylate-series monomers, such as styrene and acrylonitrile may be co-polymerized with said acryl-series monomers. A preferred monomer is methyl methacrylate. It is preferred that methyl methacrylate is contained in terms of preparation mass ratio of 50 mass % or more in the polymer.

As the polyester resin that can be used in the present invention, there can be used conventionally known saturated polyester resins. Examples of an acid component of the polyester resin that can be used in the present invention include aromatic dicarboxylic acids such as terephthalic acid, isophthalic acid, orthophthalic acid, 2,6-naphthalene dicarboxylic acid, teterahydrophthalic acid, hexahydrophthalic acid, hexahydroisophthalic acid, and hexahydroterephthalic acid; aliphatic dicarboxylic acids such as succinic acid, adipic acid, azelaic acid, sebacic acid, dodecanedionic acid, and dimmer acid; and alicyclic dicarboxylic acids such as cyclohexane dicarboxylic acid, tricyclodecane dicarboxylic acid, and decalin dicarboxylic acid. Methyl-esterified derivatives of these compounds may be also used. Further, acid anhydrides of these compounds may be also used.

Further, if necessary, the above-mentioned compounds may be also used together with other compounds such as p-(hydroxyethoxy)benzoic acid, hydroxypivalic acid, γ-butyryllactone, ϵ-caprolactone, fumaric acid, maleic acid, maleic acid anhydrate, itaconic acid, and citraconic acid. Further, if necessary, the above-mentioned compounds may be also used together with tri- or more multi-functional polycarboxylic acids such as tri or tetra carboxylic acids (e.g., trimellitic acid, pyromellitic acid), in so far as the proportion of the tri- or more multi-functional polycarboxylic acids is 10 mol % or less of the entire carboxylic acid components. Particularly preferred is the composition that contains at least one acid component which is an aromatic dicarboxylic acid a part of which is substituted with a sulfonic acid or a salt thereof, in one molecular chain. It is preferable to conduct polymerization with setting the upper limit of a substitution amount of the sulfonic acid (or salt thereof) within a range that ensures solubility to organic solvents, since this would make it possible to use the polyester resin with mixing with other organic-solvent-soluble additives or resins. As a preferable aromatic dicarboxylic acid substituted with the sulfonic acid (or salt thereof), there are exemplified sulfoterephthalic acid, 5-sulfoisophthalic acid, 4-sulfophthalic acid, 4-sulfonaphthalene-2,7-dicarboxylic acid, 5-(4-sulfophenoxy)isophthalic acid, ammonium salts of these acids, and metal salts of these acids wherein examples of the metal include lithium, potassium, magnesium, calcium, copper, and iron. Of these acids, sodium salt of 5-sulfoisophthalic acid is especially preferred.

Examples of a polyol component that is another component of the polyester resin that can be used in the present invention, include ethylene glycol, 1,2-propylene glycol, 1,3-propane diol, 1,4-butane diol, neopentyl glycol, 1,5-pentane diol, 1,6-hexane diol, 3-methyl-1,5-pentane diol, 1,9-nonane diol, 2-ethyl-2-butylpropane diol, hydroxypivalic acid neopentylglycol ester, dimethylolheptane, and 2,2,4-trimethyl-1,3-pentane diol. If necessary, there can be also used diethylene glycol, triethylene glycol, dipropylene glycol, polyethylene glycol, polypropylene glycol, polytetramethylene glycol, ethylene oxide adducts of neopentyl glycol, and propylene oxide adducts of neopentyl glycol.

As aromatic-group-containing glycols, there are paraxylene glycol, metaxylene glycol, orthoxylene glycol, 1,4-phenylene glycol, ethylene oxide adduct of 1,4-phenylene glycol, bisphenol A, and glycols obtained by adding from 1 to several moles of ethylene oxide or propylene oxide to the two phenolic hydroxyl groups of bisphenols, such as ethylene oxide adducts or propylene oxide adducts of bisphenol A. Examples of alicyclic diol components include tricyclodecane diol, tricyclodecane dimethylol, tricyclodecane dimethanol (TCD-M), cyclohexane diol, 1,4-cyclohexane dimethanol, hydrogenated bisphenol A, ethylene oxide adducts or propylene oxide adducts of hydrogenated bisphenol A. As the above-described polyester resin, a preferable glass transition temperature is within the range from 50° C. to 120° C., and a preferable molecular weight is within the range from 2,000 to 40,000. A molecular weight ranging from 4,000 to 20,000 is more preferred, because so-called "foil-off" properties at the time of transfer of the protective layer are improved.

The use of the above-described ionizing radiation-curable resins enables to obtain a protective layer that is excellent in both resistance to plasticizers and scratch resistance in particular. As an example, there are resins that are obtained by cross-linking and curing radical polymerizable polymers or oligomers upon irradiation of ionizing radiation. At this moment, polymerization and cross-link may be performed by adding a photopolymerization initiator in accordance with necessity, followed by irradiation of electron beam or ultraviolet ray. Further, known ionizing radiation-curable resins can be used.

It is also a preferable embodiment that the protective layer contains ultraviolet-absorbing agents and/or ultraviolet-shielding resins in order to give light-fastness to the printed matter.

With respect to these ultraviolet-absorbing agents, it is preferred to use a combination of ultraviolet-absorbing agents having a different properties from each other so that an effective ultraviolet-absorbing wavelength region can be covered in accordance with characteristics of the dye that is used for image formation. With respect to the non-reactive ultraviolet-absorbing agents, a mixture of ultraviolet-absorbing agents having a different structure from each other is preferably used in order to prevent the ultraviolet-absorbing agent from deposition.

Examples of the organic fillers and/or the inorganic fillers include polyethylene wax, bis-amide, nylon, acrylic resin, cross-linked polystyrene, silicone resin, silicone rubber, talc, calcium carbonate, titanium oxide, alumina, and silica fine-particles such as micro silica and colloidal silica. In the heat-sensitive transfer sheet of the present invention, not only these exemplified materials, but also known other materials can be used suitably.

With respect to the organic fillers and/or the inorganic fillers, it is preferred that a particle diameter of the fillers is 10 μm or less, preferably in the range of from 0.1 μm to 3 μm, and the fillers have good sliding properties and high transparency. An addition amount of the filler is preferably not much more than a degree to which transparency is kept at the time of transfer. Specifically, the addition amount is preferably in the range of from 0 to 100 mass parts, based on 100 mass parts of the resin.

Although characteristics of the protective layer vary depending on the kind of protective layer-forming resin, the protective layer is formed by the same method as the method of forming the above-described dye layer. A thickness of the protective layer is preferably in the range of from about 0.5 μm to about 10 μm.

<Releasing Layer>

In the case where the protective layer 4*b* is difficult to strip from the support 2 at the time of transfer, it is also a preferable embodiment to form a releasing layer 4*a* between the support 2 and the protective layer 4*b*. The releasing layer can be formed by the steps of preparing a coating liquid composed of a material that is excellent in release properties, such as waxes, silicone wax, silicone resin, and fluorine resin; a relatively high melting point resin that does not melt by heat transferred from a thermal head, such as cellulosic resin, acrylic resin, polyurethane resin, polyvinyl acetal resin, acrylic vinyl ether resin, maleic acid anhydride resin, silicone resin, fluorine resin; or the above-described resins containing a heat release agent such as waxes, and then coating the coating liquid according to a known coating method such as gravure coat and gravure reverse coat, followed by drying. Of these resins, preferred are acryl resins obtained by polymerizing acrylic acid or methacrylic acid singly, or copolymerizing acrylic acid or methacrylic acid with other monomers. These acrylic resins are excellent in adhesion to the support, and release properties from the protective layer. Further, these resins may be used alone or in a combination of these resins.

The releasing layer 4*a* remains at the side of a support at the time of printing (transfer).

A thickness of the layer is preferably in the range of from about 0.5 μm to about 10 μm. Various kinds of particles are incorporated in the releasing layer, or alternatively a surface of the releasing layer at the protective layer-coating side is subjected to a matt treatment, thereby to mat the surface of the releasing layer. Resultantly, the surface of the image-receiving sheet after printing can be mat-finished (flatten).

A separation layer may be formed between the transferable protective layer 4*b* and the releasing layer 4*a*. The separation layer is transferred together with the protective layer. After transfer, the separation layer becomes the outermost layer of the printed image-receiving sheet. Therefore, the separation layer is composed of a resin that is excellent in transparency, abrasion resistance and chemical resistance. As the resin, there are exemplified acrylic resin, epoxy resin, polyester resin, and styrene resin. Further, additives such as fillers and waxes may be added to the separation layer.

<Adhesive Layer>

It is preferred to dispose an adhesive layer 4*c* on the protective layer 4*b* as the outermost layer of the transferable protective layer laminate 4. Thereby, transfer properties of the protective layer are improved. In the adhesive layer, there can be used known pressure-sensitive adhesives, heat-sensitive adhesives, and thermoplastic resins. Specific examples of the adhesives include resins that are excellent in adhesiveness at the time of heating, such as polyester resin, vinyl chloride/vinyl acetate copolymer resin, acrylic resin, acrylic material-ultraviolet absorbing agent copolymer resin, ultraviolet absorbing resin, butyral resin, epoxy resin, polyamide resin, vinyl chloride resin, and polycarbonate resin. Of these resins, preferred are thermoplastic resins having a glass transition temperature (Tg) of from 40° C. to 80° C.

If Tg is too low, adhesiveness between the coated image and the transparent protective layer tends to become insufficient. On the other hand, if Tg is too high, transfer properties of the transparent protective layer tends to become insufficient.

Among these, especially preferred are polyvinylchloride resins, polyvinyl acetate resins, and vinyl chloride/vinyl acetate copolymer resins, each of which has a polymerization degree of from 50 to 300, more preferably from 50 to 250.

As the ultraviolet absorbing resin, there can be used resins such as products that are obtained by reaction and bonding of a thermoplastic resin or an ionizing radiation curable resin with a reactive ultraviolet absorbing agent.

The adhesive layer may contain ultraviolet absorbing agents as described above. Further, it is optional to add other additives such as coloring pigments, white pigments, extender pigments, fillers, antistatic agents, antioxidants, and fluorescent whitening agents in accordance with necessity. The adhesion layer is formed by coating and then drying a coating liquid containing the above-described resin for construction of the adhesion layer, and the above-described additives that are optionally added to the adhesion layer, so that a thickness of the adhesion layer preferably becomes a range of from 0.5 μm to about 10 μm at the dry state. The thickness of the adhesive layer is preferably within the range from 0.5 μm to 5 μm, more preferably from 0.5 μm to 3 μm.

<Ultraviolet Absorber>

The ultraviolet absorber preferably absorbs light at wavelengths in the ultraviolet region, and the absorption edge of the absorption of the ultraviolet absorber is preferably out of the visible region. Specifically, after addition of the ultraviolet absorbing agent to a receptor layer so as to form a heat-sensitive transfer image-receiving sheet, it is preferred that the resultant heat-sensitive transfer image-receiving sheet has the maximum absorption in the wavelength region of from 330 nm to 370 nm and has an absorption density Abs of 0.8 or more at the maximum absorption wavelength, more preferably has an absorption density Abs of 0.5 or more at 380 nm. Further, the heat-sensitive transfer image-receiving sheet has an absorption density of, preferably, Abs 0.1 or less at 400 nm. If the absorption density at a wavelength range exceeding 400 nm is high, it is not preferable because an image is made yellowish.

As the ultraviolet absorbing agents, use can be made of conventionally known inorganic or organic ultraviolet absorbing agents. As the organic ultraviolet absorbing agents, use as the ultraviolet-shielding resin can be made of non-reactive ultraviolet absorbing agents such as salicylate-series, benzophenone-series, benzotriazole-series, triazine-series, substituted acrylonitrile-series, nickel chelate-series, and hindered amine-series ultraviolet absorbing agents; and copolymers or graft polymers of thermoplastic resins (e.g., acrylic resins) and activated products obtained by introducing to the above-described non-reactive ultraviolet absorbing agents; addition-polymerizable double bonds originated from a vinyl group, an acryroyl group, a methacryroyl group, or the like, or alternatively by introducing thereto other types of groups such as an alcoholic hydroxyl group, an amino group, a carboxyl group, an epoxy group, and an isocyanate group. Of these ultraviolet absorbing agents, preferred are organic ultraviolet absorbing agents as described below, especially benzophenone-series, benzotriazole-series, and triazine-series ultraviolet absorbing agents.

In addition, disclosed is a method of obtaining ultraviolet-shielding resins by the steps of dissolving ultraviolet absorbing agents in a monomer or oligomer of the resin to be used in the protective layer, and then polymerizing the monomer or oligomer (JP-A-2006-21333). In this case, the ultraviolet absorbing agents may be non-reactive.

Examples of commercially available ultraviolet absorbing agents include TINUVIN-P (trade name, manufactured by Ciba-Geigy), JF-77 (trade name, manufactured by JOHOKU CHEMICAL CO., LTD.), SEESORB 701 (trade name, manufactured by SHIRAISHI CALCIUM KAISHA, LTD.), SUMISOUB 200 (trade name, manufactured by Sumitomo Chemical Co., Ltd.), BIOSOUP 520 (trade name, manufactured by KYODO CHEMICAL CO., LTD.), and ADKSTAB LA-32 (trade name, manufactured by ADEKA).

In the present invention, the ultraviolet absorber may be made to have a higher molecular weight. In this case, the ultraviolet absorber has a mass average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, the polymer containing a unit having ultraviolet absorbing ability (ultraviolet absorber unit) may be made to be used in a form of a latex. When the polymer is made to be used in a form of a latex, an aqueous dispersion-system coating solution may be used in application and coating to form the receptor layer, and this enables reduction of production cost. As a method of making the latex polymer (or making the polymer latex-wise), a method described in, for example, Japanese Patent No. 3450339 may be used. As the ultraviolet absorber to be used in a form of a latex, the following commercially available ultraviolet absorbers may be used which include ULS-700, ULS-1700, ULS-1383MA, ULS-1635 MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of using the polymer containing a unit having ultraviolet absorbing ability in a form of a latex, it may be mixed with a latex of the receptor polymer capable of being dyed, and the resulting mixture is coated. By doing so, a receptor layer, in which the ultraviolet absorber is homogeneously dispersed, can be formed.

The addition amount of the polymer containing a unit having ultraviolet absorbing ability or its latex is preferably 5 to 50 parts by mass, and more preferably 10 to 30 parts by mass, to 100 parts by mass of the receptor polymer capable of being dyed or its latex to be used to form the receptor layer.

The ultraviolet absorber may be either an organic compound or an inorganic compound.

In the case of the organic ultraviolet absorber, those represented by any of formulae (1) to (8) are preferable.

Formula (1)

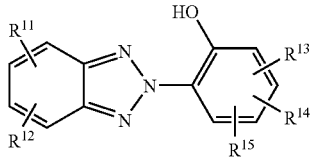

In formula (1), $R^{11}$, $R^{12}$, $R^{13}$, $R^{14}$, and $R^{15}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group.

Formula (2)

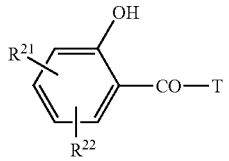

In formula (2), $R^{21}$ and $R^{22}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group. T represents an aryl group, a heterocyclic group, or an aryloxy group. T preferably represents an aryl group.

Formula (3)

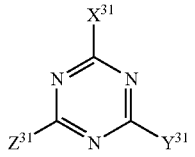

In formula (3), $X^{31}$, $Y^{31}$ and $Z^{31}$ each independently represent a substituted or unsubstituted alkyl group, aryl group, alkoxy group, aryloxy group, alkylthio group, arylthio group or heterocyclic group. At least one of $X^{31}$, $Y^{31}$ and $Z^{31}$ represents a group represented by the following Formula (a).

Formula (a)

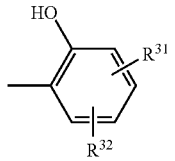

In formula (a), $R^{31}$ and $R^{32}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group. Also, the neighboring $R^{31}$ and $R^{32}$ may be combined to form a ring.

Formula (4)

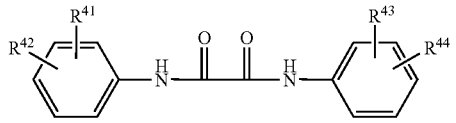

In formula (4), $R^{41}$, $R^{42}$, $R^{43}$, and $R^{44}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group.

Formula (5)

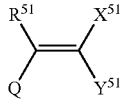

In formula (5), Q represents an aryl group or a five- or six-membered heterocyclic group, $R^{51}$ represents a hydrogen atom or an alkyl group, $X^{51}$ and $Y^{51}$ each independently represent a cyano group, —$COOR^{52}$, —$CONR^{52}R^{53}$, —$COR^{52}$, —$SO_2OR^{52}$ or —$SO_2NR^{52}R^{53}$, wherein $R^{52}$ and $R^{53}$ each independently represent a hydrogen atom, an alkyl group or an aryl group. One among $R^{52}$ and $R^{53}$ preferably represents a hydrogen atom. Also, $X^{51}$ and $Y^{51}$ may be combined to form a five- or six-membered ring. When $X^{51}$ and $Y^{51}$ are respectively a carboxyl group, they may respectively have a salt form, Formula (6)

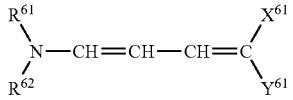

In formula (6), $R^{61}$ and $R^{62}$ each independently represent a hydrogen atom, an alkyl group or an aryl group, or nonmetal atoms necessary for forming a five- or six-membered ring by bonding with each other. Also, any one of $R^{61}$ and $R^{62}$ may be combined with the methine group adjacent to the nitrogen atom to form a five- or six-membered ring. $X^{61}$ and $Y^{61}$ may be the same or different and have the same meanings as $R^{51}$ and $X^{51}$ in formula (5).

Formula (7)

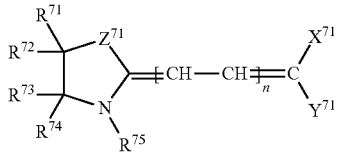

In formula (7), $R^{71}$, $R^{72}$, $R^{73}$, and $R^{74}$ may be the same or different, and each independently represent a hydrogen atom, an alkyl group or an aryl group, provided that $R^{71}$ and $R^{74}$ may be combined with each other to form a double bond, wherein when $R^{71}$ and $R^{74}$ are combined with each other to form a double bond, $R^{72}$ and $R^{73}$ may be combined with each other to form a benzene ring or a naphthalene ring. $R^{75}$ represents an alkyl group or an aryl group, $Z^{71}$ represents an oxygen atom, a sulfur atom, a methylene group, an ethylene group, >N—$R^{76}$ or >C($R^{77}$)($R^{78}$), where $R^{76}$ represents an alkyl group or an aryl group, and $R^{77}$ and $R^{78}$ may be the same or different and respectively represent a hydrogen atom or an alkyl group. $X^{71}$ and $Y^{71}$ may be the same or different, and have the same meanings as $X^{51}$ and $Y^{51}$ in the formula (5). n denotes 0 or 1.

Formula (8)

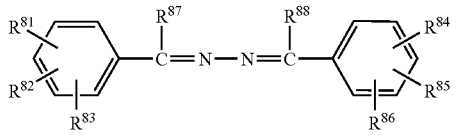

In formula (8), $R^{81}$, $R^{82}$, $R^{83}R^{84}R^{85}$, and $R^{86}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group; $R^{87}$ and $R^{88}$ may be the same or different and each represent a hydrogen atom, an alkyl group, or an aryl group, and $R^{87}$ and $R^{88}$ may bond together to form a 5- or 6-membered ring.

In the formulae (1) to (8) and (a), each substituent in, for example, groups having an alkyl part, aryl part or heterocyclic part may be substituted with the following substituents. In the explanations of each group described in the formulae (1) to (8) and (a), specific examples include exemplified groups of the corresponding groups among the groups shown below.

Such groups (including atoms and groups) will be explained and exemplified hereinbelow.

Specific examples include: a halogen atom (e.g. a chlorine atom, a bromine atom, or an iodine atom); an alkyl group [which represents a substituted or unsubstituted linear, branched, or cyclic alkyl group, and which includes an alkyl group (preferably an alkyl group having 1 to 30 carbon atoms, e.g. a methyl group, an ethyl group, an n-propyl group, an isopropyl group, a t-butyl group, an n-octyl group, an eicosyl group, a 2-chloroethyl group, a 2-cyanoethyl group, or a 2-ethylhexyl group), a cycloalkyl group (preferably a substituted or unsubstituted cycloalkyl group having 3 to 30 carbon atoms, e.g. a cyclohexyl group, a cyclopentyl group, or a 4-n-dodecylcyclohexyl group), a bicycloalkyl group (preferably a substituted or unsubstituted bicycloalkyl group having 5 to 30 carbon atoms, i.e. a monovalent group obtained by removing one hydrogen atom from a bicycloalkane having 5 to 30 carbon atoms, e.g. a bicyclo[1,2,2]heptan-2-yl group or a bicyclo[2,2,2]octan-3-yl group), and a tricyclo or higher structure having three or more ring structures; and an alkyl group in substituents described below (e.g. an alkyl group in an alkylthio group) represents such an alkyl group of the above concept]; an alkenyl group [which represents a substituted or unsubstituted linear, branched, or cyclic alkenyl group, and which includes an alkenyl group (preferably a substituted or unsubstituted alkenyl group having 2 to 30 carbon atoms, e.g. a vinyl group, an allyl group, a prenyl group, a geranyl group, or an oleyl group), a cycloalkenyl group (preferably a substituted or unsubstituted cycloalkenyl group having 3 to 30 carbon atoms, i.e. a monovalent group obtained by removing one hydrogen atom from a cycloalkene having 3 to 30 carbon atoms, e.g. a 2-cyclopenten-1-yl group or a 2-cyclohexen-1-yl group), and a bicycloalkenyl group (which represents a substituted or unsubstituted bicycloalkenyl group, preferably a substituted or unsubstituted bicycloalkenyl group having 5 to 30 carbon atoms, i.e. a monovalent group obtained by removing one hydrogen atom from a bicycloalkene having one double bond, e.g. a bicyclo[2,2,1]hept-2-en-1-yl group or a bicyclo[2,2,2]oct-2-en-4-yl group)]; an alkynyl group (preferably a substituted or unsubstituted alkynyl group having 2 to 30 carbon atoms, e.g. an ethynyl group, a propargyl group, or a trimethylsilylethynyl group); an aryl group (preferably a substituted or unsubstituted aryl group having 6 to 30 carbon atoms, e.g. a phenyl group, a p-tolyl group, a naphthyl group, an m-chlorophenyl group, or an o-hexadecanoylaminophenyl group); a heterocyclic group (preferably a monovalent group obtained by removing one hydrogen atom from a substituted or unsubstituted 5- or 6-membered aromatic or nonaromatic heterocyclic compound; more preferably a 5- or 6-membered aromatic heterocyclic group having 3 to 30 carbon atoms, e.g. a 2-furyl group, a 2-thienyl group, a 2-pyrimidinyl group, a 2-benzothiazolyl group); a cyano group; a hydroxyl group; a nitro group; a carboxyl group; an alkoxy group (preferably a substituted or unsubstituted alkoxy group having 1 to 30 carbon atoms, e.g. a methoxy group, an ethoxy group, an isopropoxy group, a t-butoxy group, an n-octyloxy group, or a 2-methoxyethoxy group); an aryloxy group (preferably a substituted or unsubstituted aryloxy group having 6 to 30 carbon atoms, e.g. a phenoxy group, a 2-methylphenoxy group, a 4-t-butylphenoxy group, a 3-nitrophenoxy group, or a 2-tetradecanoylaminophenoxy group); a silyloxy group (preferably a silyloxy group having 3 to 20 carbon atoms, e.g. a trimethylsilyloxy group or a t-butyldimethylsilyloxy group); a heterocyclic oxy group (preferably a substituted or unsubstituted heterocyclic oxy group having 2 to 30 carbon atoms, e.g. a 1-phenyltetrazol-5-oxy group or a 2-tetrahydropyranyloxy group); an acyloxy group (preferably a formyloxy group, a substituted or unsubstituted alkylcarbonyloxy group having 2 to 30 carbon atoms, or a substituted or unsubstituted arylcarbonyloxy group having 7 to 30 carbon atoms, e.g. a formyloxy group, an acetyloxy group, a pivaloyloxy group, a stearoyloxy group, a benzoyloxy group, or a p-methoxyphenylcarbonyloxy group); a carbamoyloxy group (preferably a substituted or unsubstituted carbamoyloxy group having 1 to 30 carbon atoms, e.g. an N,N-dimethylcarbamoyloxy group, an N,N-diethylcarbamoyloxy group, a morpholinocarbonyloxy group, an N,N-di-n-octylaminocarbonyloxy group, or an N-n-octylcarbamoyloxy group); an alkoxycarbonyloxy group (preferably a substituted or unsubstituted alkoxycarbonyloxy group having 2 to 30 carbon atoms, e.g. a methoxycarbonyloxy group, an ethoxycarbonyloxy group, a t-butoxycarbonyloxy group, or an n-octylcarbonyloxy group); an aryloxycarbonyloxy group (preferably a substituted or unsubstituted aryloxycarbonyloxy group having 7 to 30 carbon atoms, e.g. a phenoxycarbonyloxy group, a p-methoxyphenoxycarbonyloxy group, or a p-n-hexadecyloxyphenoxycarbonyloxy group); an amino group (preferably an amino group, a substituted or unsubstituted alkylamino group having 1 to 30 carbon atoms, or a substituted or unsubstituted arylamino group having 6 to 30 carbon atoms, e.g. an amino group, a methylamino group, a dimethylamino group, an anilino group, an N-methyl-anilino group, or a diphenylamino group); an acylamino group (preferably a formylamino group, a substituted or unsubstituted alkylcarbonylamino group having 1 to 30 carbon atoms, or a substituted or unsubstituted arylcarbonylamino group having 6 to 30 carbon atoms, e.g. a formylamino group, an acetylamino group, a pivaloylamino group, a lauroylamino group, a benzoylamino group, or a 3,4,5-tri-n-octyloxyphenylcarbonylamino group); an aminocarbonylamino group (preferably a substituted or unsubstituted aminocarbonylamino group having 1 to 30 carbon atoms, e.g. a carbamoylamino group, an N,N-dimethylaminocarbonylamino group, an N,N-diethylaminocarbonylamino group, or a morpholinocarbonylamino group); an alkoxycarbonylamino group (preferably a substituted or unsubstituted alkoxycarbonylamino group having 2 to 30 carbon atoms, e.g. a methoxycarbonylamino group, an ethoxycarbonylamino group, a t-butoxycarbonylamino group, an n-octadecyloxycarbonylamino group, or an N-methyl-methoxycarbonylamino group); an aryloxycarbonylamino group (preferably a substituted or unsubstituted aryloxycarbonylamino group having 7 to 30 carbon atoms, e.g. a phenoxycarbonylamino group, a p-chlorophenoxycarbonylamino group, or an m-n-octyloxyphenoxycarbonylamino group); a sulfamoylamino group (preferably a substituted or unsubstituted sulfamoylamino group having 0 to 30 carbon atoms, e.g. a sulfamoylamino group, an N,N-dimethylaminosulfonylamino group, or an N-n-octylaminosulfonylamino group); an alkyl- or aryl-sulfonylamino group (preferably a substituted or unsubstituted alkylsulfonylamino group having 1 to 30 carbon atoms, or a substituted or unsubstituted arylsulfonylamino group having 6 to 30 carbon atoms, e.g. a methylsulfonylamino group, a butylsulfonylamino group, a phenylsulfonylamino group, a 2,3,5-trichlorophenylsulfonylamino group, or a p-methylphenylsulfonylamino group); a mercapto group; an alkylthio group (preferably a substituted or unsubstituted alkylthio group having 1 to 30 carbon atoms, e.g. a methylthio group, an ethylthio group, or an n-hexadecylthio group); an arylthio group (preferably a substituted or unsubstituted arylthio group having 6 to 30 carbon atoms, e.g. a phenylthio group, a p-chlorophenylthio group, or an m-methoxyphenylthio group); a heterocyclic thio group (preferably a substituted or unsubstituted heterocyclic thio group having 2 to 30 carbon atoms, e.g. a 2-benzothiazolylthio group or a 1-phenyltetrazol-5-ylthio group); a sulfamoyl group (preferably a substituted or unsubstituted sulfamoyl group having 0 to 30 carbon atoms, e.g. an N-ethylsulfamoyl group, an N-(3-dodecyloxypropyl)sulfamoyl group, an N,N-dimethylsulfamoyl group, an N-acetylsulfamoyl group, an N-benzoylsulfamoyl group, or an N—(N'-phenylcarbamoyl)sulfamoyl group); a sulfo group; an alkyl- or aryl-sulfinyl group (preferably a substituted or unsubstituted alkylsulfinyl group having 1 to 30 carbon atoms, or a substituted or unsubstituted arylsulfinyl group having 6 to 30 carbon atoms, e.g. a methylsulfinyl group, an ethylsulfinyl group, a phenylsulfinyl group, or a p-methylphenylsulfinyl group); an alkyl- or aryl-sulfonyl group (preferably a substituted or unsubstituted alkylsulfonyl group having 1 to 30 carbon atoms, or a substituted or unsubstituted arylsulfonyl group having 6 to 30 carbon atoms, e.g. a methylsulfonyl group, an ethylsulfonyl group, a phenylsulfonyl group, or a p-methylphenylsulfonyl group); an acyl group (preferably a formyl group, a substituted or unsubstituted alkylcarbonyl group having 2 to 30 carbon atoms, a substituted or unsubstituted arylcarbonyl group having 7 to 30 carbon atoms, or a substituted or unsubstituted heterocyclic carbonyl group having 4 to 30 carbon atoms, which is bonded to said carbonyl group through a carbon atom, e.g. an acetyl group, a pivaloyl group, a 2-chloroacetyl group, a stearoyl group, a benzoyl group, a p-n-octyloxyphenylcarbonyl group, a 2-pyridylcarbonyl group, or a 2-furylcarbonyl group); an aryloxycarbonyl group (preferably a substituted or unsubstituted aryloxycarbonyl group having 7 to 30 carbon atoms, e.g. a phenoxycarbonyl group, an o-chlorophenoxycarbonyl group, an m-nitrophenoxycarbonyl group, or a p-t-butylphenoxycarbonyl group); an alkoxycarbonyl group (preferably a substituted or unsubstituted alkoxycarbonyl group having 2 to 30 carbon atoms, e.g. a methoxycarbonyl group, an ethoxycarbonyl group, a t-butoxycarbonyl group, or an n-octadecyloxycarbonyl group); a carbamoyl group (preferably a substituted or unsubstituted carbamoyl group having 1 to 30 carbon atoms, e.g. a carbamoyl group, an N-methylcarbamoyl group, an N,N-dimethylcarbamoyl group, an N,N-di-n-octylcarbamoyl group, or an N-(methylsulfonyl)carbamoyl group); an aryl- or heterocyclic-azo group (preferably a substituted or unsubstituted aryl azo group having 6 to 30 carbon atoms, or a substituted or unsubstituted heterocyclic azo group having 3 to 30 carbon atoms, e.g. a phenylazo group, a p-chlorophenylazo group, or a 5-ethylthio-1,3,4-thiadiazol-2-ylazo group); an imido group (preferably an N-succinimido group or an N-phthalimido group); a phosphino group (preferably a substituted or unsubstituted phosphino group having 2 to 30 carbon atoms, e.g. a dimethylphosphino group, a diphenylphosphino group, or a methylphenoxyphosphino group); a phosphinyl group (preferably a substituted or unsubstituted phosphinyl group having 2 to 30 carbon atoms, e.g. a phosphinyl group, a dioctyloxyphosphinyl group, or a diethoxyphosphinyl group); a phosphinyloxy group (preferably a substituted or unsubstituted phosphinyloxy group having 2 to 30 carbon atoms, e.g. a diphenoxyphosphinyloxy group or a dioctyloxyphosphinyloxy group); a phosphinylamino group (preferably a substituted or unsubstituted phosphinylamino group having 2 to 30 carbon atoms, e.g. a dimethoxyphosphinylamino group or a dimethylaminophosphinylamino group); a silyl group (preferably a substituted or unsubstituted silyl group having 3 to 30 carbon atoms, e.g. a trimethylsilyl group, a t-butyldimethylsilyl group, or a phenyldimethylsilyl group).

Among the substituents, with respect to one having a hydrogen atom, the hydrogen atom may be removed and be substituted by any of the above-mentioned substituents. Examples thereof include: an alkylcarbonylaminosulfonyl group, a arylcarbonylaminosulfonyl group, an alkylsulfonylaminocarbonyl group, and an arylsulfonylaminocarbonyl group. Specific examples thereof include a methylsulfonylaminocarbonyl group, a p-methylphenylsulfonylaminocarbonyl group, an acetylaminosulfonyl group, and a benzoylaminosulfonyl group.

When the ultraviolet absorber represented by any one of the formulas (1) to (8) is water-soluble, it is preferred to have an ionic hydrophilic group. The ionic hydrophilic group includes a sulfo group, a carboxyl group, a phosphono group, and a quaternary ammonium group. As the ionic hydrophilic group, a carboxyl group, a phosphono group, and a sulfo group are preferred, and a carboxyl group and a sulfo group are particularly preferred. The carboxyl group, phosphono group, and sulfo group may be in the state of a salt, and the examples of the counter ions for forming the salts include an ammonium ion, an alkali metal ion (e.g., a lithium ion, a sodium ion, and a potassium ion), and an organic cation (a tetramethylammonium ion, a tetramethylguanidium ion, and a tetramethylphosphonium ion).

Among ultraviolet absorbers represented by any one of the Formulae (1) to (8), those represented by any one of the Formulae (1) to (4) are preferable in the point that they themselves have high light fastness, and those represented by any one of the Formulae (1) to (3) are further preferable in view of absorbing characteristics. Among these absorbers, those represented by the Formula (1) or (3) are particularly preferable. In the case where the ultraviolet absorber is used in a basic condition, on the other hand, compounds represented by any one of the Formulae (4) to (8) are preferable from the viewpoint of preventing coloring caused by dissociation.

Preferred examples of the compounds represented by any one of the formulae (1) to (8) include compounds specifically exemplified, for example, in JP-B-48-30492 ("JP-B" means examined Japanese patent publication), JP-B-55-36984, JP-B-55-125875, JP-B-36-10466, JP-B-48-5496, JP-A-46-3335, JP-A-58-214152, JP-A-58-221844, JP-A-47-10537, JP-A-59-19945, JP-A-63-53544, JP-A-51-56620, JP-A-53-128333, JP-A-58-181040, JP-A-6-211813, JP-A-7-258228, JP-A-8-239368, JP-A-8-53427, JP-A-10-115898, JP-A-10-147577, JP-A-10-182621, JP-T-8-501291 ("JP-T" means searched and published International patent publication), U.S. Pat. No. 3,754,919, No. 4,220,711, No. 2,719,086, No. 3,698,707, No. 3,707,375, No. 5,298,380, No. 5,500,332, No. 5,585,228, No. 5,814,438, British Patent No. 1,198,337, European Patents No. 323408A, No. 520938A, No. 521823A, No. 531258A, No. 530135A, and No. 520938A. Among these, TINUVIN P and TINUVIN 900 (trade names, manufactured by Ciba Specialty Chemicals) are more preferred. The compounds represented by any one of the formulae (1) to (8) can be synthesized by or according to any of the methods described in the above publications.

Also, the structures, material properties and action mechanisms of typical ultraviolet absorbers are described in Andreas Valet, "Light Stabilizers for Paint", issued by Vincentz.

<Back Layer>

The back surface of the heat-sensitive transfer sheet directly contacts with a heating device such as a thermal head, and the sheet is transported while the back surface is heated. Therefore, it is preferred to dispose a back layer on the back surface of the support in order to smooth the transporting by preventing the back surface from being heat sealed with the heating device such as a thermal head.

In the back layer, there can be used natural or synthetic resins such as cellulosic resins (for example, ethyl cellulose, hydroxy cellulose, hydroxypropyl cellulose, methyl cellulose, cellulose acetate, cellulose acetate butyrate, and nitro cellulose), vinyl-series resins (for example, polyvinyl alcohol, polyvinyl acetate, polyvinyl butyral, polyvinyl acetal, and polyvinyl pyrrolidone), acrylic resins (for example, polymethyl methacrylate, polyethyl methacrylate, polyacryl amide, and acrylonitrile-styrene copolymer), polyamide resins, polyvinyl toluene resins, cumarone indene resins, polyester-series resins, polyurethane resins, silicone-modified or fluorine-modified urethane resins, and silicone resins, and mixtures of these resins.

In order to improve heat resistance of the back layer, it is a preferable embodiment that the back layer is modified with a crosslinking agent into a crosslinked resin layer.

Further to improve transporting, it is preferable to contain a solid or liquid releasing agent or sliding agent in the back layer. As the solid or liquid releasing agent or sliding agent, known compounds can be used. Examples of these compounds include various kinds of waxes such as carnauba wax, montan wax, polyethylene wax, and paraffin wax, zinc stearate, stearic acid amide, higher aliphatic acid alcohol, organopolysiloxane, anionic surfactants, cationic surfactants, amphoteric surfactants, nonionic surfactants, fluorine-series surfactants, organic carboxylic acid and their derivatives, fluorine-series resins, silicone-series resin, phosphate-series compounds, and organic or inorganic fine-particles.

Such the back layer can be formed using a known coating method. A thickness of the back layer is preferably in the range of from 0.1 μm to 10 μm, more preferably from 0.3 μm to 5 μm, and especially preferably from 0.5 μm to 3 μm.

The present invention can provide materials (i.e. a cardboard cylinder adapted for winding a heat-sensitive transfer image-receiving sheet, and a rolled heat-sensitive transfer image-receiving sheet to form a roll shape) that are used for heat-sensitive transfer having suitability of high speed print, without causing unexpected slip of the heat-sensitive transfer sheet in the process of the heat-sensitive transfer.

According to the image-forming method using a heat-sensitive transfer image-receiving sheet wound around the cardboard cylinder of the present invention, a print can be obtained at high speed, without causing unexpected slip of the heat-sensitive transfer sheet in the course of the heat-sensitive transfer.

The present invention will be described in more detail based on the following examples, but the invention is not intended to be limited thereto. In the following examples, the terms "part(s)" and "%" are values by mass, unless otherwise specified.

EXAMPLES

[Preparation of Cardboard Cylinder]

A liner base paper (210 g/m$^2$) was spirally rolled four rounds, and intervals between each of layers were fixed with adhesives. The thus-obtained cardboard cylinder was measured off 152 mm, to prepare a cardboard cylinder A for comparison.

On the inner surface of the cardboard cylinder A, a latex-containing dispersion for anti-slipping was applied, followed by drying, to prepare a cardboard cylinder B for comparison.

On one surface of the above-described liner base paper, a microcapsule-containing dispersion for anti-slipping was applied, and then the resultant liner base paper was spirally rolled one round so that a coated surface of the dispersion for anti-slipping would become the innermost surface of the roll. Subsequently, the liner base paper was spirally rolled, and intervals between each of layers were fixed with adhesives. The thus-obtained cardboard cylinder was measured off 152 mm. Thereafter, the microcapsules were foamed by heating, to prepare a cardboard cylinder C for comparison.

A wood free paper (board) one surface of which had been laminated with polyethylene (total thickness: about 0.1 mm; polyethylene layer: polyethylene, number average molecular weight 20,000, thickness 15 μm) was spirally rolled one round so that said polyethylene laminate surface would become the innermost surface. Subsequently, a liner base paper was spirally rolled one round on the wood free paper roll, and intervals between each of layers were fixed with adhesives. The thus-obtained cardboard cylinder was measured off 152 mm, to prepare a cardboard cylinder D according to the present invention.

An internal diameter of these cardboard cylinders was in the range of from 87.5 mm to 88.0 mm. A thickness of these cardboard cylinders was in the range of from 0.9 mm to 1.1 mm.

[Preparation of Member for Friction Measurement]

The structures of the inner surface of the foregoing cardboard cylinders A to E) were reproduced on each one surface of the liner base paper, to prepare members A to D for measuring coefficient of friction, respectively. Namely, the member A was a liner base paper itself. The member B was a liner base paper on the surface of which a latex-containing dispersion for anti-slipping was applied, followed by drying. The member C was a liner base paper on the surface of which a microcapsule-containing dispersion for anti-slipping was, followed by drying, and then the microcapsules were foamed by heating. The member D was a liner base paper on the surface of which a polyethylene-laminated wood free paper (total thickness: about 0.1 mm; polyethylene layer: polyethylene, melting point 120° C., number average molecular weight 20,000, thickness 15 μm) was attached with additives to fix.

[Preparation of Heat-sensitive Image-receiving Sheet]

Preparation of Image-receiving Sheet

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the receptor layer (the lower receptor layer, and the upper receptor layer), each having the following composition, were multilayer-coated on the gelatin undercoat layer in this order from the side of the support, by a method illustrated in FIG. 9 in U.S. Pat. No. 2,761,791. The coating was performed so that coating amounts after drying of the subbing layer, the heat insulation layer, the lower receptor layer, and the upper receptor layer would be 6.8 g/m$^2$, 8.2 g/m$^2$, 2.4 g/m$^2$ and 2.9 g/m$^2$, respectively. Further, the polymer layer containing inorganic fine-particles was provided by coating on the other side of the support, which was opposite to the receptive layer side, so that the coating amount after drying thereof would be 12.0 g/m$^2$

| Upper receptor layer | |
|---|---|
| Vinyl chloride-series latex (as a solid content) (trade name: Vinybran 900, manufactured by Nisshin Chemicals Co., Ltd.) | 22.2 mass parts |
| Vinyl chloride-series latex (as a solid content) (trade name: Vinybran 276, manufactured by Nisshin Chemicals Co., Ltd.) | 2.5 mass parts |
| Gelatin | 0.4 mass part |
| The following ester-series wax EW-1 | 2.2 mass parts |
| The following surfactant F-1 | 0.04 mass part |

| Lower receptor layer | |
|---|---|
| Vinyl chloride-series latex (as a solid content) (trade name: Vinybran 690, manufactured by Nisshin Chemicals Co., Ltd.) | 24.4 mass parts |
| Gelatin | 1.6 mass parts |
| The following surfactant F-1 | 0.04 mass part |

| Heat insulation layer | |
|---|---|
| Latex hollow polymer particles (as a solid content) (trade name: MH5055, manufactured by Nippon Zeon Co., Ltd.) | 580 mass parts |
| Gelatin | 270 mass parts |

| Subbing layer | |
|---|---|
| Polyvinyl alcohol (trade name: POVAL PVA 205, manufactured by Kuraray) | 17.2 mass parts |
| Latex styrene/butadiene rubber (as a solid content) (trade name: SN-307, manufactured by NIPPON A & L INC.) | 150 mass parts |
| The following surfactant F-1 | 0.1 mass part |

| Polymer layer containing inorganic fine-particles on the other side of support opposite to the receptive layer side | |
|---|---|
| Polyvinyl alcohol | 20 mass parts |
| Colloidal silica (sphere-equivalent diameter 0.05 μm) | 0.05 mass part |
| Alumina sol (sphere-equivalent diameter 4 μM) | 0.1 mass part |

(EW-1)

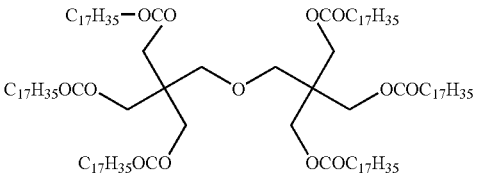

(F-1)

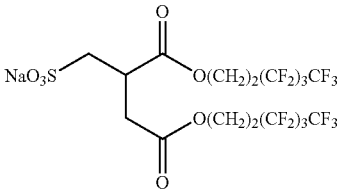

[Preparation of Rolled Heat-sensitive Transfer Image-receiving Sheet to Form a Roll Shape]

The foregoing heat-sensitive transfer image-receiving sheet was initiated to wind on a shaft having an internal diameter of 88 mm so that an image-receiving surface of the sheet with a width of 152 mm and a length of 60 m became outside. Then, the outer surface of the first round roll and the inner surface of the second round roll in the order from the shaft were fixed with a double-coated tape, and subsequently the image-receiving sheet was continuously wound around the shaft, to prepare a rolled heat-sensitive transfer image-receiving sheet to form a roll shape (hereinafter, abbreviated to "rolled image-receiving sheet") 1 for comparison (i.e. a rolled image-receiving sheet 1 for comparison).

The above-described heat-sensitive transfer image-receiving sheet with a width of 152 mm was attached to an outer surface of the foregoing cardboard cylinder A with an adhesive tape to fix them, and subsequently the image-receiving sheet was continuously wound around the shaft unit, to prepare a rolled image-receiving sheet 2 for comparison.

A rolled image-receiving sheet 3 for comparison was prepared in the same manner as the rolled image-receiving sheet 2 for comparison, except that the foregoing cardboard cylinder B was used in place of the cardboard cylinder A.

A rolled image-receiving sheet 4 for comparison was prepared in the same manner as the rolled image-receiving sheet 2 for comparison, except that the foregoing cardboard cylinder C was used in place of the cardboard cylinder A.

A rolled image-receiving sheet 5 for comparison was prepared in the same manner as the rolled image-receiving sheet 2 for comparison, except that the foregoing cardboard cylinder D was used in place of the cardboard cylinder A.

The masses of the resultant rolled image-receiving sheets were within the range from 2.2 kg to 2.3 kg.

[Measurement of Friction]

The above-described heat-sensitive transfer image-receiving sheet was fixed on a horizontal movable stage so that the surface of the image-receiving sheet opposite to the receptive layer side was taken upward. On the sheet, was placed a flat polycarbonate member with a width of 30 mm and a length of 36 mm. Further, a weight (load) was placed on the polycarbonate member so that a total mass of the polycarbonate member and the weight became 100 g. The polycarbonate member was fixed in connection with a load cell (i.e. a torque-detecting sensor). Then, the measurement was made in the manner that a resistance force charged at the time when a slip was caused between the surface of the image-receiving sheet opposite to the receptive layer side and the flat polycarbonate member, by moving the movable stage. A value of the measured resistance force divided by normal load was calculated. The value obtained with respect to the maximum resistance force at the beginning of the slip was designated as coefficient of static friction. Further, the value obtained with respect to a stable resistance force after the beginning of the slip was designated as coefficient of dynamic friction.

In the aforementioned measurement, friction coefficients with respect to the above-mentioned members were obtained in the same manner as above, except that the heat-sensitive transfer image-receiving sheet used in the above was replaced with the members A to D for measuring friction, respectively.

[Measurement of Slip Torque between Rolled Image-receiving Sheet and Shaft Unit]

A polycarbonate shaft was inserted into the above-described rolled image-receiving sheet 1 of a heat-sensitive transfer image-receiving sheet, and fixed so that the shaft could not turn round. Further, the end of the outermost periphery of the heat-sensitive transfer image-receiving sheet in the rolled image-receiving sheet 1 was fixed in connection with a load cell (torque-detecting sensor). The end of the heat-sensitive transfer image-receiving sheet was taken out in the state that the shaft could not turn round, and a torque was measured in the state that slip was occurring between the inner surface of the rolled image-receiving sheet 1 and the shaft. The larger value means that such a slip is more difficult to occur. Torque with respect to each member was measured in the same manner as the foregoing measurement, except that the above-described rolled image-receiving sheets 2 to 5 were used in place of the rolled image-receiving sheet 1, respectively.

Next, a detailed explanation is given below with respect to the polycarbonate shaft that was used in the instant measurement.

A circular arc-like movable member was mounted at the outer surface of the shaft. The movable member was connected to a core shaft member through a spring. The movable member was forced into the inner surface of the rolled image-receiving sheet. In such the state, the movable member was fixed while being pressed by a force of spring against the inner surface of the rolled image-receiving sheet. In such a manner, the movable members were mounted at 4 places in the circumferential direction of both right and left shafts, respectively, i.e., 8 places in total. Each movable member was connected to a core shaft member through an individual spring. The movable member was set so that the movable member was able to move to a direction along the line from the center of the shaft, but unable to the circumferential direction.

Further, torque was measured in the same manner as the foregoing measurement, changing strength of the spring.

The results of coefficient of frictions are shown in Table 1. The results of torque measurements are shown in Table 2.

TABLE 1

| Member | Static coefficient of friction | Dynamic coefficient of friction |
|---|---|---|
| Surface of image-receiving sheet opposite to the receptive layer side | 0.19 | 0.17 |
| Member A (liner base paper) | 0.18 | 0.16 |
| Member B (latex-containing anti-slipping agent on the surface of liner base paper) | 0.68 | 0.44 |
| Member C (foaming-microcapsule-containing anti-slipping agent on the surface of liner base paper) | 1.90 | 1.35 |
| Member D (polyethylene on the surface of liner base paper) | 0.20 | 0.17 |

TABLE 2

| Rolled image-receiving sheet | | Sliding torque (N) | |
|---|---|---|---|
| | | Spring | |
| Name (Remarks) | Innermost surface | constant standard | Spring constant 1.8 times |
| Rolled image-receiving sheet 1 (Comparative example) | Surface of image-receiving sheet opposite to receptive layer side | 27.0 | 28.2 |
| Rolled image-receiving sheet 2 (Comparative example) | Surface of liner base paper | 26.1 | 22.7 |
| Rolled image-receiving sheet 3 (Comparative example) | Latex-containing anti-slipping agent layer | * | * |
| Rolled image-receiving sheet 4 (Comparative example) | Foaming-microcapsule-containing anti-slipping agent layer | 31.2 | 30.2 |
| Rolled image-receiving sheet 5 (This invention) | Polyethylene layer | 53.3 | 49.7 |

(Note)

* The rolled image-receiving sheet was so hard to insert a shaft therein. When the shaft was inserted with force in the rolled image-receiving sheet, the innermost surface of the rolled image-receiving sheet was broken.

As is apparent from the results shown in Tables 1 and 2, with respect to both the rolled image-receiving sheet 1 in which the image-receiving sheet was formed in a roll shape without utilizing any paperboard cylinder and the rolled image-receiving sheet 2 in which a liner base paper per se was arranged as the innermost surface of the cardboard cylinder, the slip torque of each of these rolled image-receiving sheets 1 and 2 for comparison was quite low, which resulted in ease to slip.

Further, as is apparent from the results shown in Table 1, both coefficient of static friction and coefficient of dynamic friction of the member B and the member C were quite larger than those of other members. Accordingly, these members were expected to be effective to anti-slipping. However, as is apparent from the results shown in Table 2, with respect to both the rolled image-receiving sheets 3 and 4 for comparison, in which the innermost surface of the cardboard cylinder was composed of the foregoing members B and C respectively, a definite anti-slipping effect was not observed because increase in the slip torque between the rolled image-receiving sheet and the shaft was only slight, or when the shaft was inserted with force in the rolled image-receiving sheet, the innermost surface of the rolled image-receiving sheet was broken. Further, with respect to these rolled image-receiving sheets 1 to 4 for comparison, it was found that it was not effective for prevention of the slip, even when enhancing strength of the spring for pressing the movable member of the shaft against the innermost surface of the rolled image-receiving sheet.

In contrast to those, although the results of the member D shown in Table 1 did not indicate any significant change of coefficient of friction in the surface polyethylene layer, with respect to the rolled image-receiving sheet 5 in which a polyethylene layer was provided at the innermost surface of the cardboard cylinder to have the same structure as in the foregoing member D, it is apparent from the results shown in Table 2 that the slip torque remarkably increased, and the rolled image-receiving sheet 5 was made to be difficult to slip. Thus, it is found that the rolled image-receiving sheet 5 according to the present invention is favorable for high speed print.

Then, heat-sensitive transfer prints were produced each using the foregoing rolled image-receiving sheet 1 (for comparison), rolled image-receiving sheet 4 (for comparison), or rolled image-receiving sheet 5 (this invention), in combination with the following heat-sensitive transfer sheet.

[Preparation of Heat Transfer Sheets]

(Preparation of Heat-sensitive Transfer Sheet-coating Liquid and Protective Layer-coating Liquid)

For preparation of heat-sensitive transfer sheets, the following coating liquids were prepared.

| <Preparation of yellow-heat-transfer-layer-coating liquid Y1> | |
|---|---|
| Yellow dye Y1-6 | 2.2 mass parts |
| Yellow dye Y3-7 | 2.2 mass parts |
| Polyvinylbutyral resin (trade name: S-LEC BH-6, manufactured by Sekisui Chemical Co., Ltd.) | 4.5 mass parts |
| Methyl ethyl ketone/toluene (1/1, at mass ratio) | 90 mass parts |

| <Preparation of magenta-heat-transfer-layer-coating liquid M1> | |
|---|---|
| Magenta dye M2-1 | 1.0 mass part |
| Magenta dye M2-3 | 4.0 mass parts |
| Polyvinylbutyral resin (trade name: S-LEC BH-6, manufactured by Sekisui Chemical Co., Ltd.) | 4.5 mass parts |
| Methyl ethyl ketone/toluene (1/1, at mass ratio) | 90 mass parts |

| <Preparation of cyan-heat-transfer-layer-coating liquid C1> | |
|---|---|
| Cyan dye C1-3 | 0.5 mass part |
| Cyan dye C2-2 | 4.5 mass parts |
| Polyvinylbutyral resin (trade name: S-LEC BH-6, manufactured by Sekisui Chemical Co., Ltd.) | 4.5 mass parts |
| Methyl ethyl ketone/toluene (1/1, at mass ratio) | 90 mass parts |

| <Preparation of heat-transferable protective-layer's releasing layer-coating liquid PU1> | |
|---|---|
| Modified cellulose resin (trade name: L-30, manufactured by Daicel Chemical Industries, Ltd.) | 5 mass parts |
| Methyl ethyl ketone | 95 mass parts |

| <Preparation of heat-transferable protective-layer's peeling layer-coating liquid PO1> | |
|---|---|
| Acrylic resin solution (Solid content: 40%) (trade name: UNO-1, manufactured by Gifu Ceramics Limited) | 90 mass parts |
| Methanol/isopropanol (1/1, at mass ratio) | 10 mass parts |

| <Preparation of heat-transferable protective-layer's adhesion layer-coating liquid A1> | |
|---|---|
| Acrylic resin (trade name: DIANAL BR-77, manufactured by Mitsubishi Rayon Co., Ltd.) | 25 mass parts |
| The following ultraviolet absorber UV-1 | 1 mass part |
| The following ultraviolet absorber UV-2 | 2 mass parts |
| The following ultraviolet absorber UV-3 | 1 mass part |
| The following ultraviolet absorber UV-4 | 1 mass part |
| PMMA fine-particles (poly(methyl methacrylate) fine-particles) | 0.4 mass part |
| Methyl ethyl ketone/toluene (2/1, at mass ratio) | 70 mass parts |

(UV-1)

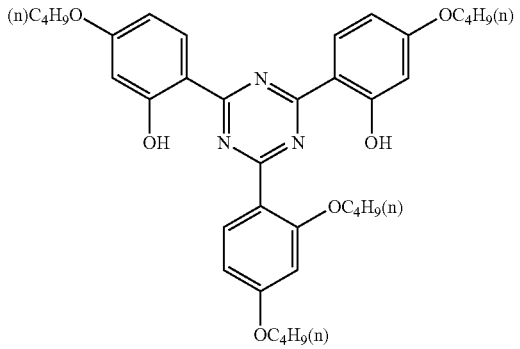

(UV-2)

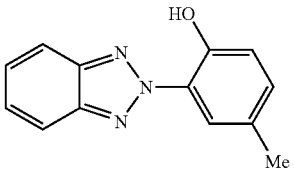

(UV-3)

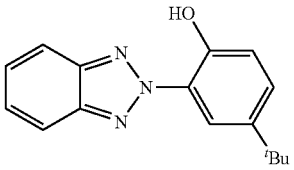

-continued

<Preparation of heat-transferable protective-layer's adhesion layer-coating liquid A1>

(UV-4)

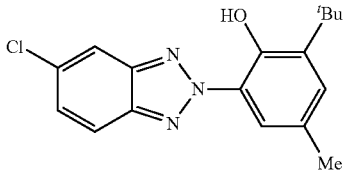

(Preparation of Back Layer-coating Solution)

In order to produce a backing heat-resistance layer of the heat-sensitive transfer sheet, the following coating liquid was prepared.

| Preparation of back side layer-coating solution BC1 | |
|---|---|
| Acrylic-series polyol resin (trade name: ACRYDIC A-801, manufactured by Dainippon Ink and Chemicals, Incorporated) | 26.0 mass parts |
| Zinc stearate (trade name: SZ-2000, manufactured by Sakai Chemical Industry Co., Ltd.) | 0.43 mass part |
| Phosphate (trade name: PLYSURF A217, manufactured by Dai-ichi Kogyo Seiyaku Co., Ltd.) | 1.27 mass parts |
| Isocyanate (50% solution) (trade name: BURNOCK D-800, manufactured by Dainippon Ink and Chemicals, Incorporated) | 8.0 mass parts |
| Methyl ethyl ketone/toluene (2/1, at mass ratio) | 64 mass parts |

(Preparation of Sheets by Coating of Coating Liquids Described Above)

A polyester film 6.0 μm in thickness (trade name: Diafoil K200E-6F, manufactured by Mitsubishi Polyester Film Corporation) that was subjected to an adhesion-treatment on one surface of the film, was used as a support. The back side-layer coating solution BC1 was applied onto the support on the other surface that was not subjected to the adhesion-treatment, so that the coating amount based on the solid content after drying would be 1 g/m$^2$. After drying, the thus-coated film was hardened by heating at 60° C.

A heat-sensitive transfer sheet A was prepared by applying the above-described coating liquids on the surface that was subjected to the adhesion-treatment of the thus-prepared polyethylene film so that a yellow heat-sensitive transfer layer, a magenta heat-sensitive transfer layer, a cyan heat-sensitive transfer layer, and a protective layer were provided in area order. In the case of forming the protective layer, the protective layer's releasing layer-coating liquid PU1 was applied and dried, and then the protective layer's peeling layer-coating liquid PO1 was applied on the releasing layer and dried, and then the protective layer's adhesion layer-coating liquid A1 was applied on the peeling layer.

A coating amount of each layer applied in this preparation was controlled so that the solid content coating amount would become the value set forth below.

| | |
|---|---|
| Yellow heat-transfer layer | 0.9 g/m$^2$ |
| Magenta heat-transfer layer | 0.8 g/m$^2$ |
| Cyan heat-transfer layer | 1.0 g/m$^2$ |
| Protective releasing layer | 0.3 g/m$^2$ |
| Protective peeling layer | 0.5 g/m$^2$ |
| Protective adhesive layer | 2.0 g/m$^2$ |

[Image Formation 1]

First, the rolled image-receiving sheet 1 in the state that both shafts had been put in the rolled image-receiving sheet was mounted in the printer. Further, the foregoing heat-sensitive transfer sheet was also placed in a printer. Then, the image-receiving sheet at the outer periphery portion of the rolled image-receiving sheet 1 was pull out up to a thermal head portion by means of a motor-driven roller conveyer. At the same time, the heat-sensitive transfer sheet was also pull out up to the thermal head portion by means of a motor-driven roller conveyer. The thus-pull out image-receiving sheet and heat-sensitive transfer sheet were superposed so that a heat-sensitive transfer layer and an image-receiving layer were brought in to contact with each other. A transfer printing was carried out, by heating with a thermal head from the side of the support that was used in the heat-sensitive transfer sheet. As for the order of the heat-sensitive transfer, a yellow image was first transferred, by overlapping the region corresponding to the yellow heat-sensitive transfer layer of the heat-sensitive transfer sheet onto the image-receiving sheet, heating the region with the thermal head, and then, peeling off the heat-sensitive transfer sheet from the image-receiving sheet; a magenta image was secondly transferred, by overlapping the magenta heat-sensitive transfer layer onto the image-receiving sheet, heating the region with the thermal head, and peeling off the heat-sensitive transfer sheet from the image-receiving paper; a cyan image was thirdly transferred, by overlapping the cyan heat-sensitive transfer layer onto the image-receiving sheet, heating the region with the thermal head, and peeling off the heat-sensitive transfer sheet from the image-receiving sheet; and a protective layer itself was fourthly transferred onto the heat-sensitive image-receiving sheet, by overlapping the protective layer onto the image-receiving sheet, heating the layer with the thermal head, and peeling off the heat-sensitive transfer sheet from the image-receiving sheet, thereby to give a print carrying a formed color image. The thermal head used was of a line head-type at 300 dpi (300 dots per 25.4 mm), and the printing was performed at a printing speed of 60 cm/min and a maximum heat quantity of 300 mJ/dot. In succession, 400 sheets of print were produced, with setting a print size of 102 mm×152 mm per sheet.

Further, 400 sheets of print were continuously produced without break in the same manner as the foregoing print, except that any one of the rolled image-receiving sheets 4 and 5 was used in place of the rolled image-receiving sheet 1, respectively.

In the case where a printing was carried out using the rolled image-receiving sheets 1 (for comparison) or 4 (for comparison), there arose 2 or 3 time suspensions owing to print abnormality in the course of printing. At the time of the print suspension, a power source was once shut off, to inspect affairs inside of the printer. Then, it was found in the printer that the heat-sensitive transfer image-receiving sheet had been loosened between a conveying roller and the rolled image-receiving sheet, and slip was occurred between the shaft and the rolled image-receiving sheet in contact with the shaft. In order to cure the abnormality to a normal state, it was necessary to shut off the power source at once, and thereafter to set again the heat-sensitive transfer image-receiving sheet and the heat-sensitive transfer sheet at their normal positions, and then to switch the power source on to start the printer. Thus, it is apparent that use of those rolled image-receiving sheets for comparison which need such operations, are seriously poor in productivity. In contrast, in the case where a printing was carried out using the rolled image-receiving sheet 5 (this invention), there arose no suspension owing to print abnormality, which apparently demonstrates advantageous effects of the present invention.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119(a) on Patent Application No. 2007-115677, filed in Japan on Apr. 25, 2007, which is entirely herein incorporated by reference.

What we claim is:

1. A rolled heat-sensitive transfer image-receiving sheet, wherein said heat-sensitive transfer image-receiving sheet has a receptive layer on one surface of a support and is wound around a cardboard cylinder, wherein an innermost surface of said cardboard cylinder is composed of a layer containing a polyolefin resin having a number average molecular weight of 12,000 or more and a melting point within the range from 105° C. to 180° C. in a proportion of at least 80% by mass based on the layer, wherein the amount of the layer on the innermost surface of the cardboard cylinder is 5 $g/m^2$ to 80 $g/m^2$, wherein the thickness of the cardboard cylinder is 0.4 mm to 5 mm, and wherein no slip occurs between the layer on the innermost surface of said cardboard cylinder and a shaft unit inserted into the cardboard cylinder when a torque of 35N or more is loaded between the rolled heat-sensitive transfer image-receiving sheet and the shaft unit, and wherein an outermost surface of the heat-sensitive transfer image-receiving sheet opposite to the surface having the receptive layer thereon is composed of a polymer layer containing inorganic fine-particles.

2. The rolled heat-sensitive transfer image-receiving sheet according to claim 1, wherein the polyolefin resin is a polyethylene resin.

3. The rolled heat-sensitive transfer image-receiving sheet according to claim 1, whose mass is within the range from 1.0 kg to 10 kg.

4. The rolled heat-sensitive transfer image-receiving sheet according to claim 1, whose mass is within the range from 1.5 kg to 8 kg.

5. The rolled heat-sensitive transfer image-receiving sheet according to claim 1, wherein the diameter of the cardboard cylinder is 10 mm to 40 mm.

6. An image-forming method, comprising: using the rolled heat-sensitive transfer image-receiving sheet as described in claim 1, to produce a heat-sensitive transfer print, wherein said heat-sensitive transfer print is produced at a linear speed of 20 cm/min or more.

7. The image-forming method according to claim 6, wherein the linear speed is 50 cm/min or more.

* * * * *